US009436124B2

(12) United States Patent
Eto

(10) Patent No.: US 9,436,124 B2
(45) Date of Patent: Sep. 6, 2016

(54) DEVELOPER CONTAINER AND IMAGE FORMING APPARATUS INCLUDING THE SAME

(71) Applicant: KYOCERA Document Solutions Inc., Osaka-shi, Osaka (JP)

(72) Inventor: Daisuke Eto, Osaka (JP)

(73) Assignee: KYOCERA Document Solutions Inc. (JP)

( * ) Notice: Subject to any disclaimer, the term of this patent is extended or adjusted under 35 U.S.C. 154(b) by 0 days.

(21) Appl. No.: 14/811,144

(22) Filed: Jul. 28, 2015

(65) Prior Publication Data

US 2016/0033900 A1 Feb. 4, 2016

(30) Foreign Application Priority Data

Jul. 30, 2014 (JP) ..... 2014-154765

(51) Int. Cl.
*G03G 15/08* (2006.01)

(52) U.S. Cl.
CPC ..... *G03G 15/0881* (2013.01); *G03G 15/0865* (2013.01); *G03G 15/0868* (2013.01); *G03G 15/0875* (2013.01); *G03G 15/0889* (2013.01); *G03G 2215/0668* (2013.01)

(58) Field of Classification Search
CPC ..... G03G 15/0877; G03G 15/0881; G03G 15/0889
See application file for complete search history.

(56) References Cited

U.S. PATENT DOCUMENTS

2008/0170887 A1* 7/2008 Nishimura ..... G03G 15/0896 399/262
2009/0269112 A1 10/2009 Fukunaga et al.
2010/0158575 A1* 6/2010 Maeshima ..... G03G 15/0868 399/262
2014/0079441 A1* 3/2014 Abler ..... G03G 15/0877 399/262

FOREIGN PATENT DOCUMENTS

JP 2003-280344 10/2003
JP 2009-265395 11/2009

* cited by examiner

*Primary Examiner* — David Gray
*Assistant Examiner* — Thomas Giampaolo, II
(74) *Attorney, Agent, or Firm* — Gerald E. Hespos; Michael J. Porco; Matthew T. Hespos

(57) ABSTRACT

A developer container includes a container body, a lid, a movable wall, and a sealing member. The container body includes an inner circumferential surface defining a cylindrical internal space extending in a first direction, and a wall part defining one end surface of the internal space in the first direction. The container body has a developer discharge port closer to the wall part. The movable wall includes an outer circumferential surface and a conveying surface defining a storage space for the developer. The movable wall is movable in the internal space in the first direction from an initial position closer to the lid of the container body to a terminal position closer to the wall part while conveying the developer in the storage space. The wall part has a developer filling port penetrating the wall part and communicating with the storage space. The sealing member seals the developer filling port.

10 Claims, 24 Drawing Sheets

DEVELOPER CONTAINER AND IMAGE FORMING APPARATUS INCLUDING THE SAME

INCORPORATION BY REFERENCE

This application is based on Japanese Patent Application No. 2014-154765 filed with the Japan Patent Office on Jul. 30, 2014, the contents of which are hereby incorporated by reference.

BACKGROUND

The present disclosure relates to a developer container for containing developer and an image forming apparatus including the developer container.

Conventionally, a toner container is known as a developer container for containing developer. The toner container includes a toner discharge port and a rotary stirring member. Rotation of the stirring member causes toner to be discharged through the toner discharge port.

SUMMARY

A developer container according to an aspect of the present disclosure includes a container body, a lid, a movable wall, and a sealing member. The container body includes an inner circumferential surface defining a cylindrical internal space extending in a first direction, and a wall part defining one end surface of the internal space in the first direction. The container body has a developer discharge port in one end portion of the container body to communicate with the internal space and discharge developer therethrough, the end portion being closer to the wall part. The lid is mounted on the other end portion of the container body to cover the internal space, the end being opposite to the wall part in the first direction. The movable wall includes an outer circumferential surface slidable over and in close contact with the inner circumferential surface of the container body, and a conveying surface defining a storage space for the developer in cooperation with the inner circumferential surface of the wall part of the container body. The movable wall is movable in the internal space in the first direction from an initial position closer to the lid of the container body to a terminal position closer to the wall part while conveying the developer in the storage space to the developer discharge port. The wall part has a developer filling port penetrating the wall part and communicating with the storage space. The sealing member seals the developer filling port.

An image forming apparatus according to another aspect of the present disclosure includes: the developer container described above; an image carrier configured to allow an electrostatic latent image to be formed on a surface thereof, and to carry a developed image; a developing device configured to receive developer supplied from the developer container and supply the developer to the image carrier; and a transfer section configured to transfer the developed image from the image carrier onto a sheet.

Figure 24A:
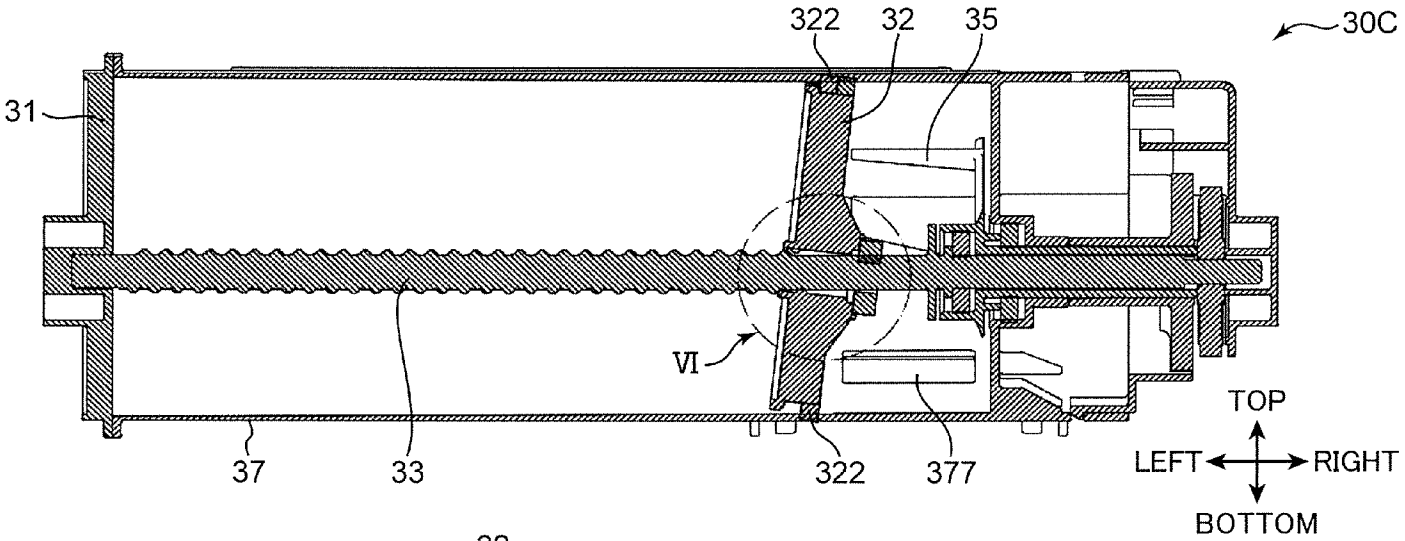
FIG. 24A is a sectional view of another developer container for comparison with the developer container according to the embodiment of the present disclosure, and FIG.

24B is an enlarged sectional view of a part of the another developer container shown in FIG. 24A.

DETAILED DESCRIPTION

Figure 1:
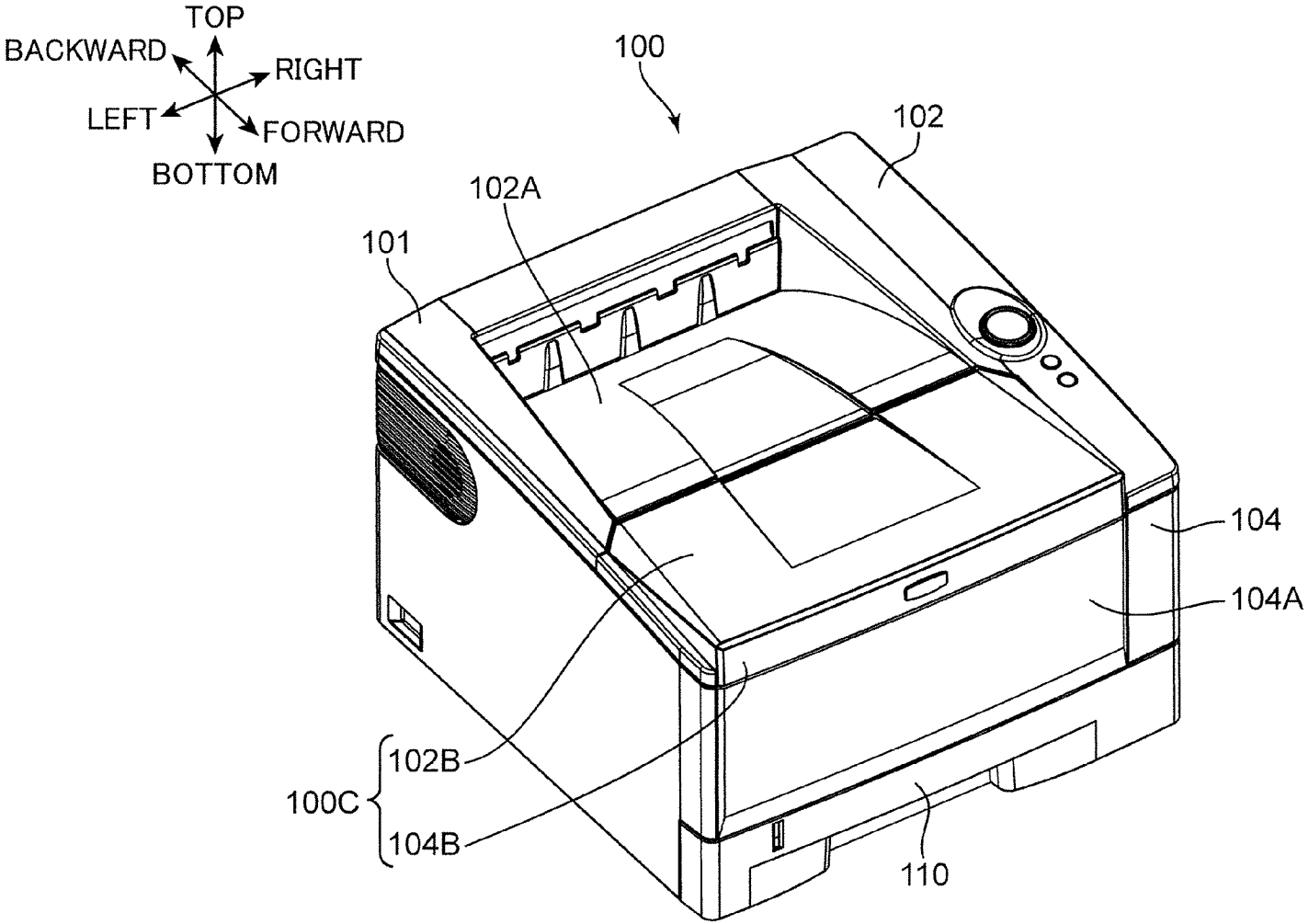
FIG. 1 is a perspective view of an image forming apparatus according to an embodiment of the present disclosure.
Figure 2:
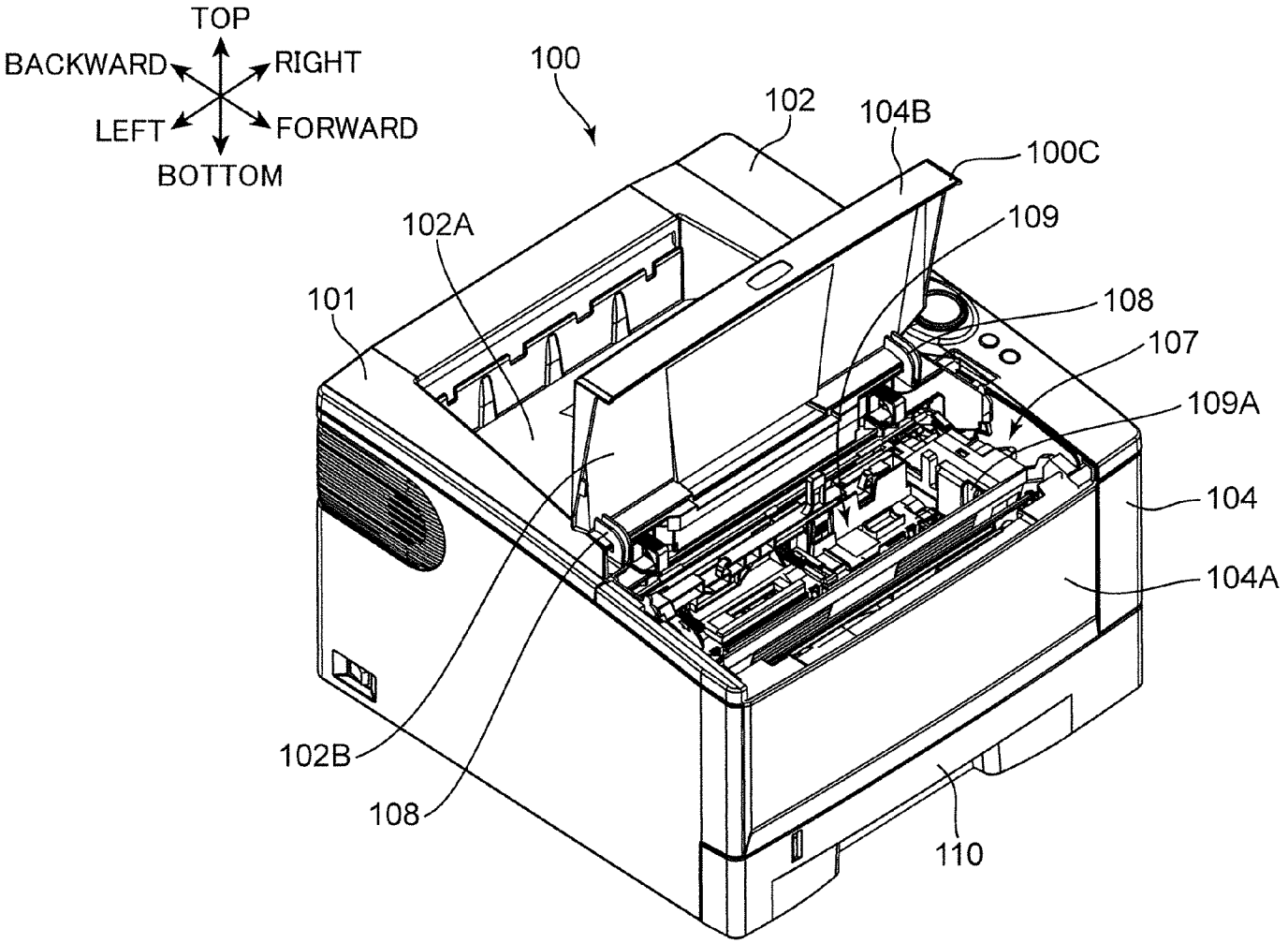
FIG. 2 is a perspective view in which the image forming apparatus according to the embodiment of the present disclosure is partially open.
Figure 3:
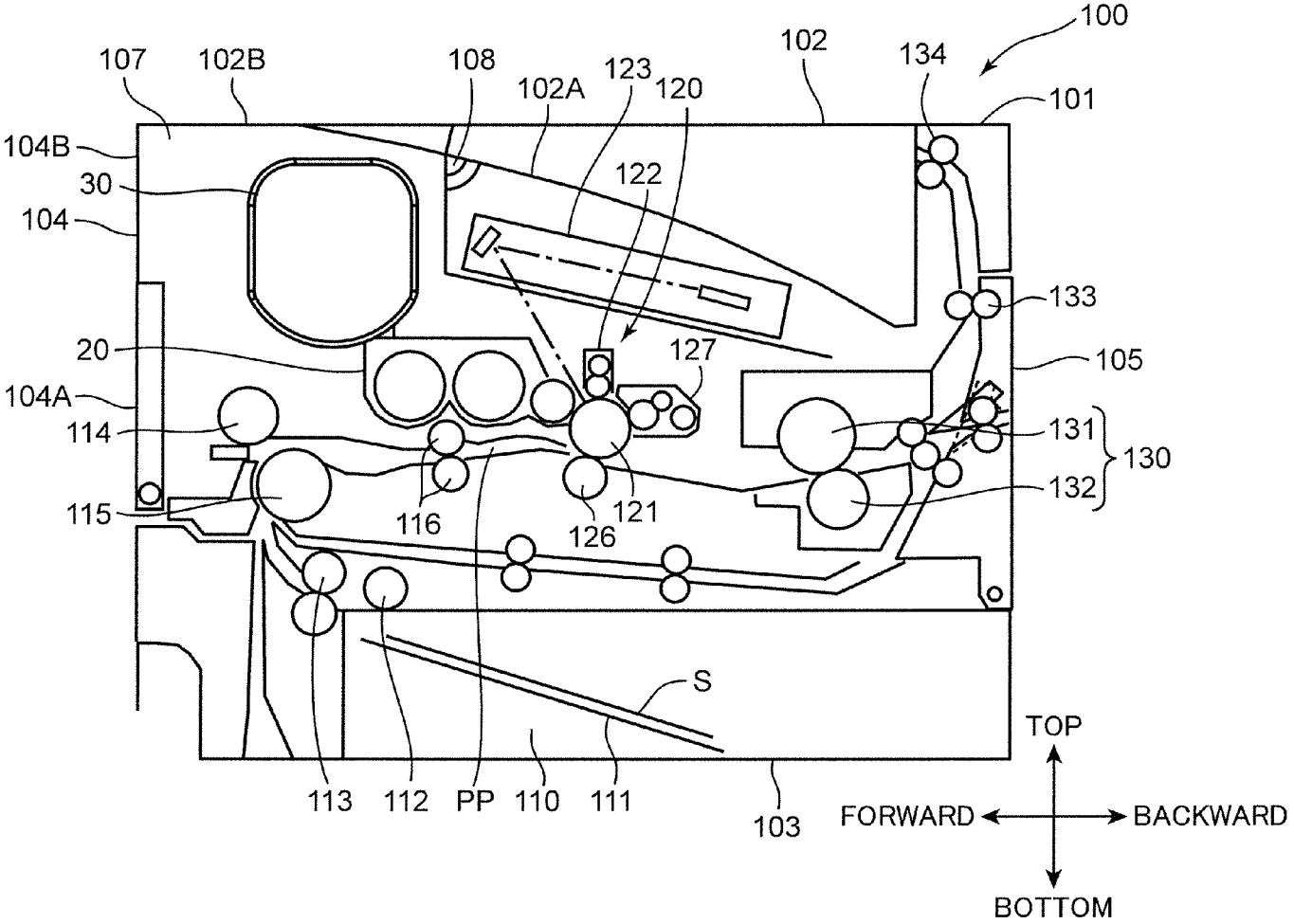
FIG. 3 is a schematic sectional view showing an internal structure of the image forming apparatus according to the embodiment of the present disclosure.

Hereinafter, an embodiment of the present disclosure will be described with reference to the accompanying drawings. FIGS. 1 and 2 are perspective views of a printer 100 (image forming apparatus) according to an embodiment of the present disclosure. FIG. 3 is a schematic sectional view showing an internal structure of the printer 100 shown in FIGS. 1 and 2. The printer 100 shown in FIGS. 1 to 3, which is an image forming apparatus, is a so-called monochrome printer. However, in other embodiment, the image forming apparatus may be a color printer, a facsimile apparatus, a multifunctional apparatus equipped with these functions, or another type of apparatus for forming a toner image on a sheet. It should be noted that hereinafter, terms indicating directions such as "top" "bottom" "forward" "backward" "left" and "right" are intended merely for descriptive purposes, and not for limiting the principle of the image forming apparatus.

The printer 100 includes a housing 101 for housing various components that are used for forming an image on a sheet S. The housing 101 includes a top wall 102 defining a top of the housing 101, a bottom wall 103 (FIG. 3) defining a bottom of the housing 101, a main body rear wall 105 (FIG. 3 disposed between the top wall 102 and the bottom wall 103, and a main body front wall 104 located in front of the main body rear wall 105. The housing 101 includes a main body internal space 107 where various components are placed. A sheet conveyance passage PP extends in the main body internal space 107 of the housing 101, and the sheet conveyance passage PP allows passage of a sheet S in a given conveying direction. Further, the printer 100 includes an opening/closing cover 100C mounted on the housing 101 in an openable and closable manner.

The opening/closing cover 100C includes a front wall upper portion 104B constituting an upper portion of the main body front wall 104, and a top wall front portion 102B constituting a front portion of the top wall 102. The opening/closing cover 100C can be vertically opened and closed with unillustrated hinge shafts acting as a fulcrum, and the hinge shafts are respectively disposed on a pair of arms 108 disposed at opposite lateral ends of the opening/closing cover 100C (FIG. 2).

A sheet discharge section 102A is disposed in a central part of the top wall 102. The sheet discharge section 102A has an oblique surface sloping downward from a front end to a rear end of the top wall 102. A sheet S that has been subjected to image formation in an image forming section 120 described later is discharged onto the sheet discharge section 102A. Further, a manual feed tray 104A is disposed in a vertically central part of the main body front wall 104.

With reference to FIG. 3, the printer 100 includes a cassette 110, a pickup roller 112, a first sheet feeding roller 113, a second sheet feeding roller 114, a conveying roller 115, a pair of registration rollers 116, the image forming section 120, and a fixing device 130.

The cassette 110 stores sheets S therein. The cassette 110 includes a lift plate 111.

The first sheet feeding roller 113 is disposed downstream of the pickup roller 112 and conveys the sheet S further downstream. The second sheet feeding roller 114 is disposed at the inner side (rear side) of the fulcrum of the manual feed tray 104A and draws a sheet placed on the manual feed tray 104A into the housing 101.

The conveying roller 115 is disposed downstream of the first sheet feeding roller 113 and the second sheet feeding roller 114 in their sheet conveying direction (hereinafter, the sheet conveying direction also being referred to simply as "conveying direction," and the downstream in the sheet conveying direction also being referred to simply as "downstream"). The conveying roller 115 conveys a sheet fed by the first sheet feeding roller 113 or the second sheet feeding roller 114 further downstream.

The pair of registration rollers 116 functions to correct the angle of a sheet S that has been obliquely conveyed. This makes it possible to adjust the position of an image to be formed on the sheet S.

The image forming section 120 includes a photoconductive drum 121 (image carrier), a charger 122, an exposure device 123, a developing device 20, a toner container 30 (developer container), a transferring roller 126 (transfer section), and a cleaning device 127.

The exposure device 123 irradiates the circumferential surface of the photoconductive drum 121 charged by the charger 122 with beams of laser light.

The developing device 20 supplies toner to the circumferential surface of the photoconductive drum 121 on which an electrostatic latent image has been formed. The toner container 30 supplies toner to the developing device 20. The toner container 30 is detachably attached to the developing device 20. When the developing device 20 supplies toner to the photoconductive drum 121, the electrostatic latent image formed on the circumferential surface of the photoconductive drum 121 is developed (visualized). Consequently, a toner image (developed image) is formed on the circumferential surface of the photoconductive drum 121.

After a toner image is transferred onto a sheet S, the cleaning device 127 removes toner remaining on the circumferential surface of the photoconductive drum 121.

The fixing device 130 is disposed downstream of the image forming section 120 in the conveying direction, and fixes a toner image on a sheet S. The fixing device 130 includes a heating roller 131 for melting toner on the sheet S, and a pressure roller 132 for bringing the sheet S into close contact with the heating roller 131.

The printer 100 further includes a pair of conveying rollers 133 disposed downstream of the fixing device 130, and a pair of discharge rollers 134 disposed downstream of the pair of conveying rollers 133. A sheet S is conveyed upward by the pair of conveying rollers 133 to be finally discharged from the housing 101 by the pair of discharge rollers 134. Sheets S are sequentially stacked on the sheet discharge section 102A.

<Developing Device>

Figure 4:
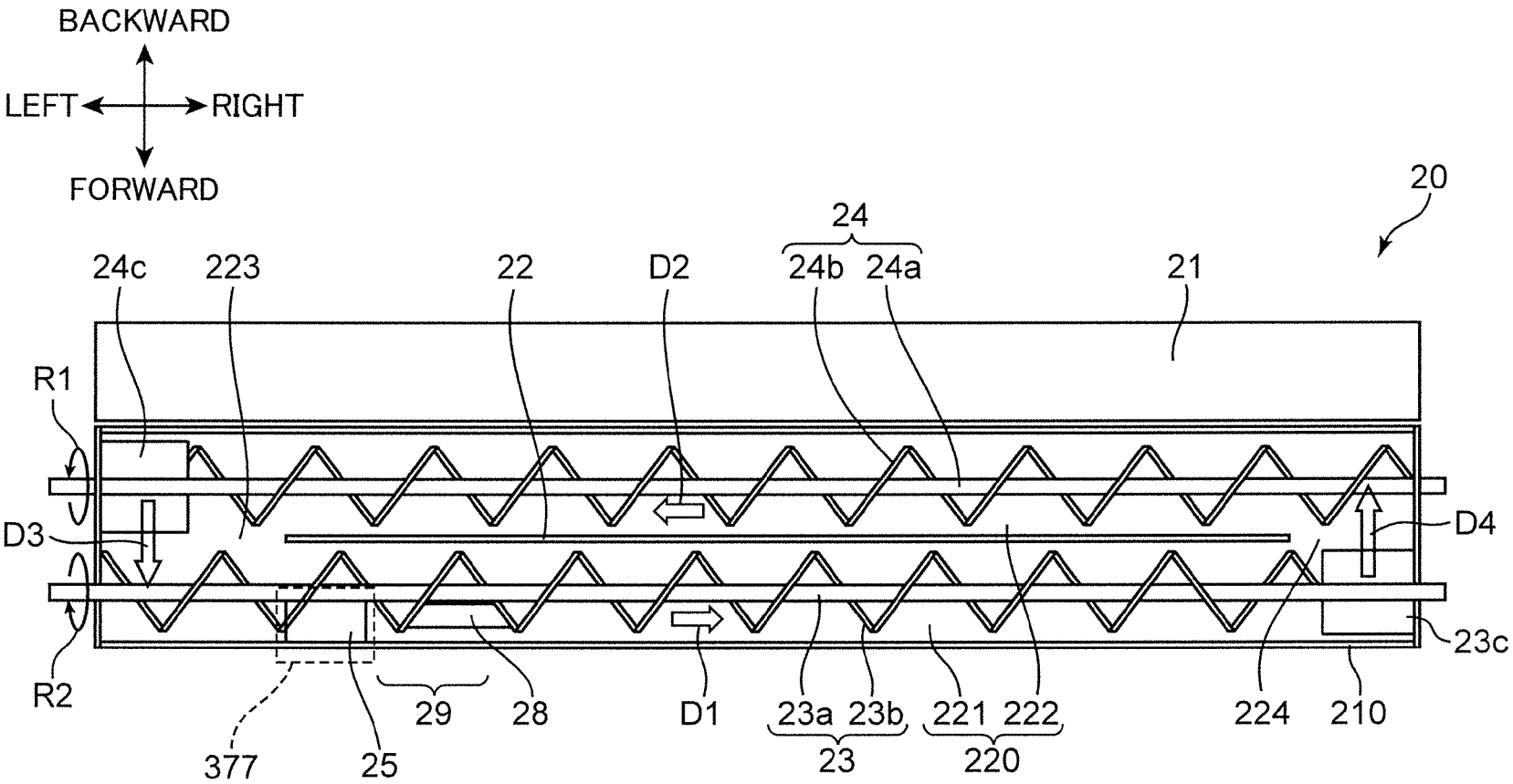
FIG. 4 is a schematic plan view showing an internal structure of a developing device according to the embodiment of the present disclosure.

FIG. 4 is a plan view showing an internal structure of the developing device 20. The developing device 20 includes a development housing 210 in the form of a box having a longer dimension in a specific direction (an axial direction of a developing roller 21 or a left-right direction). The development housing 210 has a storage space 220. In the storage space 220, there are disposed the developing roller 21, a first stirring screw 23, a second stirring screw 24, and a toner supply port 25. The present embodiment employs a one-component developing method and, therefore, the storage space 220 is filled with toner that is to be used as developer. On the other hand, in the case of a two-component developing method, a mixture of toner and carrier consisting of a magnetic material is used to fill the storage space 220 as developer. The toner is conveyed in the storage space 220, while being stirred, and is successively supplied from the developing roller 21 to the photoconductive drum 121 in order to develop an electrostatic latent image.

The developing roller 21 is in the form of a cylinder extending in the longitudinal direction of the development housing 210, and includes a sleeve constituting a circumferential portion of the developing roller 21 and operable to be rotationally driven.

The storage space 220 of the development housing 210 is covered with an unillustrated top portion and divided, by a partition plate 22 extending in the left-right direction, into a first conveyance passage 221 and a second conveyance passage 222 each having a longer dimension in the left-right direction. The partition plate 22 is shorter than the lateral width of the development housing 210 to define a first communication passage 223 and a second communication passage 224 respectively at the left and right sides of the partition plate 22, and the first and second communication passages 223 and 224 allow communication between the first conveyance passage 221 and the second conveyance passage 222. Consequently, the storage space 220 includes a circulation passage constituted by the first conveyance passage 221, the second communication passage 224, the second conveyance passage 222, and the first communication passage 223. Toner is conveyed through the circulation passage counterclockwise in FIG. 4.

The toner supply port 25 (developer receiving port) is an opening formed in the top portion of the development housing 210, and is disposed above and near a left end of the first conveyance passage 221. The toner supply port 25 faces the above-mentioned circulation passage, and functions to allow replenishment toner (replenishment developer) supplied from a toner discharge port 377 of the toner container 30 to flow into the storage space 220.

The first stirring screw 23 is disposed in the first conveyance passage 221. The first stirring screw 23 includes a first rotary shaft 23*a* and a first spiral blade 23*b* (screw blade) in the form of a spiral protrusion formed on the circumferential surface of the first rotary shaft 23*a*. The first stirring screw 23 is driven to rotate around the axis of the first rotary shaft 23*a* (in the direction of an arrow R2) to convey toner in the direction of an arrow D1 shown in FIG. 4. The first stirring screw 23 conveys developer through the first conveyance passage 221 that faces the toner supply port 25. Therefore, the first stirring screw 23 functions to convey and mix toner conveyed from the second conveyance passage 222 to the first conveyance passage 221 with new toner flowing into the first conveyance passage 221 from the toner supply port 25. A first paddle 23*c* is disposed downstream of the first stirring screw 23 in the toner conveying direction (in the arrow D1 direction). The first paddle 23*c* is a plate-shaped member disposed on the first rotary shaft 23*a*. The first paddle 23*c* is rotated with the first rotary shaft 23*a* to deliver toner from the first conveyance passage 221 to the second conveyance passage 222 in the direction of an arrow D4 shown in FIG. 4.

The second stirring screw 24 is disposed in the second conveyance passage 222. The second stirring screw 24 includes a second rotary shaft 24*a* and a second spiral blade 24*b* in the form of a spiral protrusion formed on the circumferential surface of the second rotary shaft 24*a*. The second stirring screw 24 is driven to rotate around the second rotary shaft 24*a* (in the direction of an arrow R1) to supply toner to the developing roller 21 while conveying toner in the direction of an arrow D2 shown in FIG. 4. A second paddle 24*c* is disposed downstream of the second stirring screw 24 in the toner conveying direction (in the arrow D2 direction). The second paddle 24 is rotated with the second rotary shaft 24*a* to deliver toner from the second conveyance passage 222 to the first conveyance passage 221 in the direction of an arrow D3 shown in FIG. 4.

The toner container 30 (FIG. 3) is disposed above the toner supply port 25 of the development housing 210. The toner container 30 includes the toner discharge port 377 (FIG. 4). The toner discharge port 377 is disposed in a bottom portion 371 (FIG. 8B) of the toner container 30 and corresponds to the toner supply port 25 of the development housing 20. Toner that has fallen through the toner discharge port 377 is supplied to the development device 20 through the toner supply port 25.

<Toner Supply>

Figure 5:
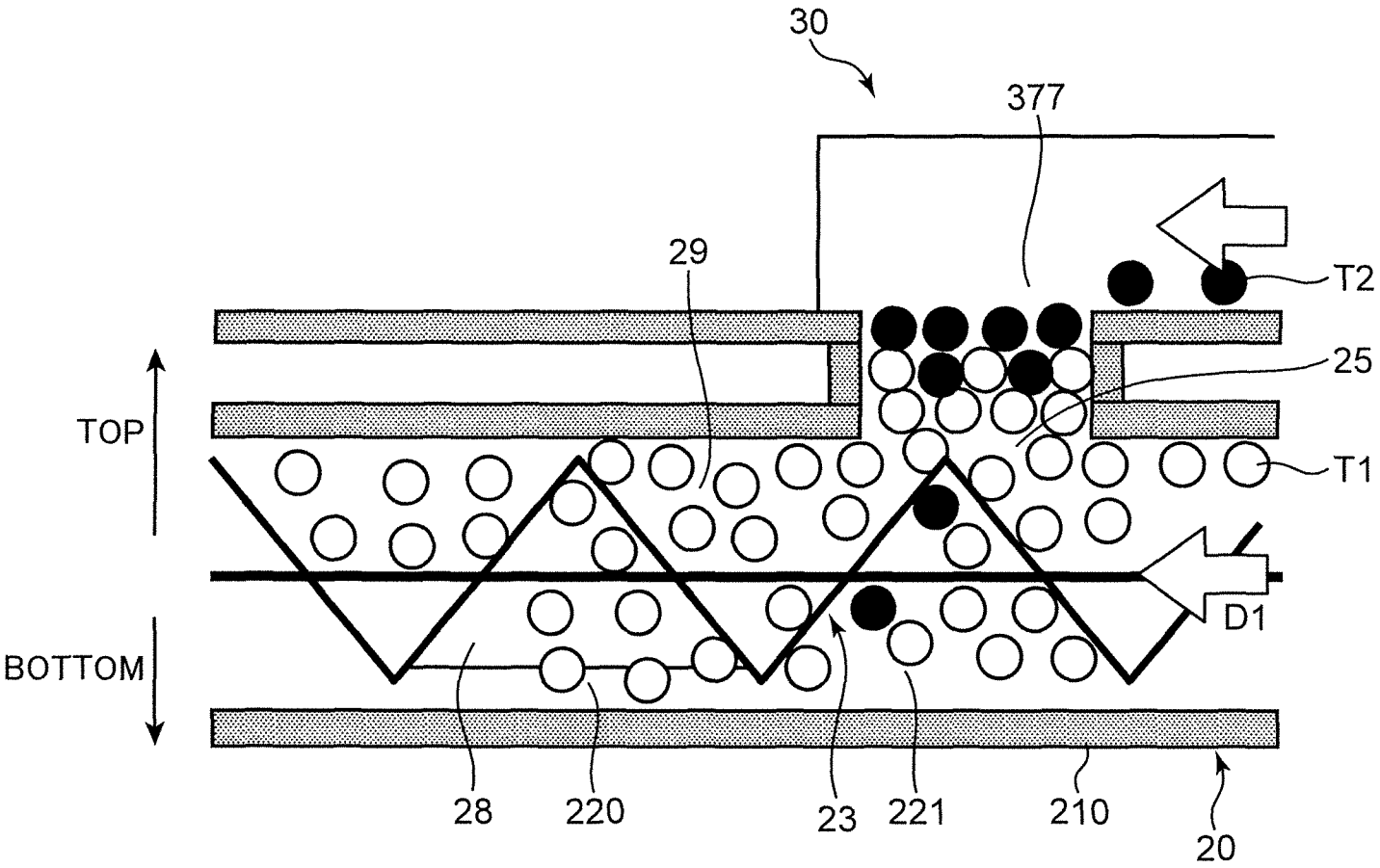
FIG. 5 is a schematic sectional view illustrating supply of developer to the developing device according to the embodiment of the present disclosure.

A flow of toner that is newly supplied through the toner supply port 25 will now be described. FIG. 5 is a sectional view of the vicinity of the toner supply port 25 disposed in the developing device 20 and the toner discharge port 377 disposed in the toner container 30.

Replenishment toner T2 that is supplied through the toner discharge port 377 of the toner container 30 falls into the first conveyance passage 221 to be mixed with existing toner T1, and the mixture of toners T1 and T2 is conveyed in the arrow D1 direction by the first stirring screw 23. At this time, the toners T1 and T2 are stirred and charged.

The first stirring screw 23 includes a reducing paddle 28 (conveying ability reducing portion) that partially reduces the ability of conveying developer and is disposed downstream of the toner supply port 25 in the toner conveying direction. In the present embodiment, the reducing paddle 28 is a plate-like member extending between adjacent points of the first spiral blade 23*b* of the first stirring screw 23. The reducing paddle 28 rotates around the first rotary shaft 23*a* to cause toner being conveyed from the upstream side of the reducing paddle 28 to start accumulating. The accumulation of toner grows up to a position immediately upstream of the reducing paddle 28, that is, a position where the toner supply port 25 faces the first conveyance passage 221. As a result, a developer accumulation portion 29 (developer accumulation portion) appears near the inlet of the toner supply port 25.

When the amount of toner in the storage space 220 increases due to the supply of replenishment toner T2 though the toner supply port 25, the toner accumulating in the accumulation portion 29 covers (seals) the toner supply port 25, which prevents further toner supply. Thereafter, when the amount of the toner in the accumulation portion 29 decreases because of consumption of the toner in the storage space 220 by the developing roller 21, the amount of toner covering the toner supply port 25 decreases such that a gap appears between the accumulation portion 29 and the toner supply port 25. This allows new inflow of replenishment toner T2 into the storage space 220 through the toner supply port 25. In this manner, the present embodiment employs the volume replenishment type toner supply method in which the amount of replenishment toner to be received is adjusted in accordance with a decrease in the amount of toner in the accumulation portion 29.

<Mounting of Toner Container into Developing Device>

Figure 6:
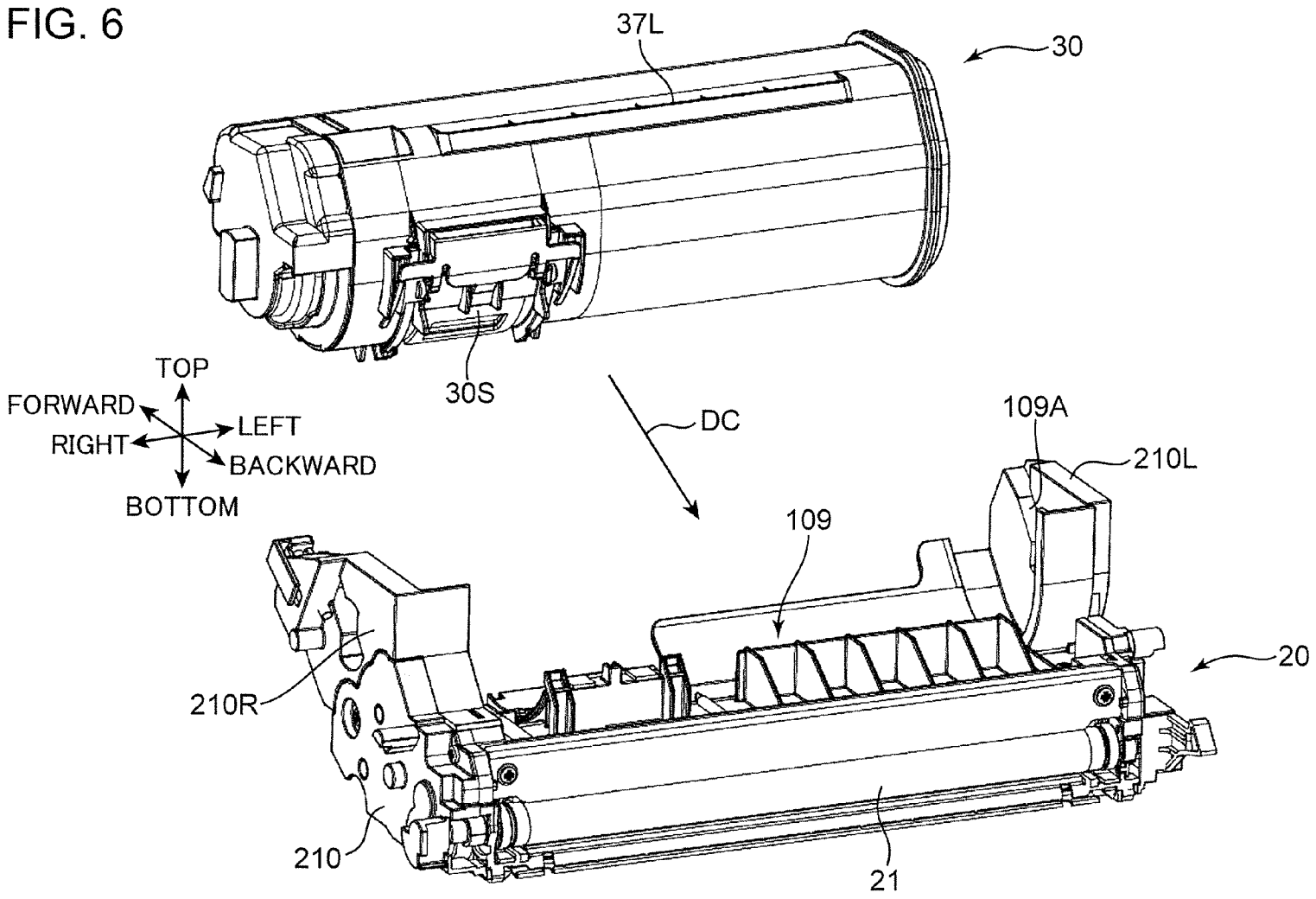
FIG. 6 is a perspective view of a developer container and the developing device according to the embodiment of the present disclosure.
Figure 7:
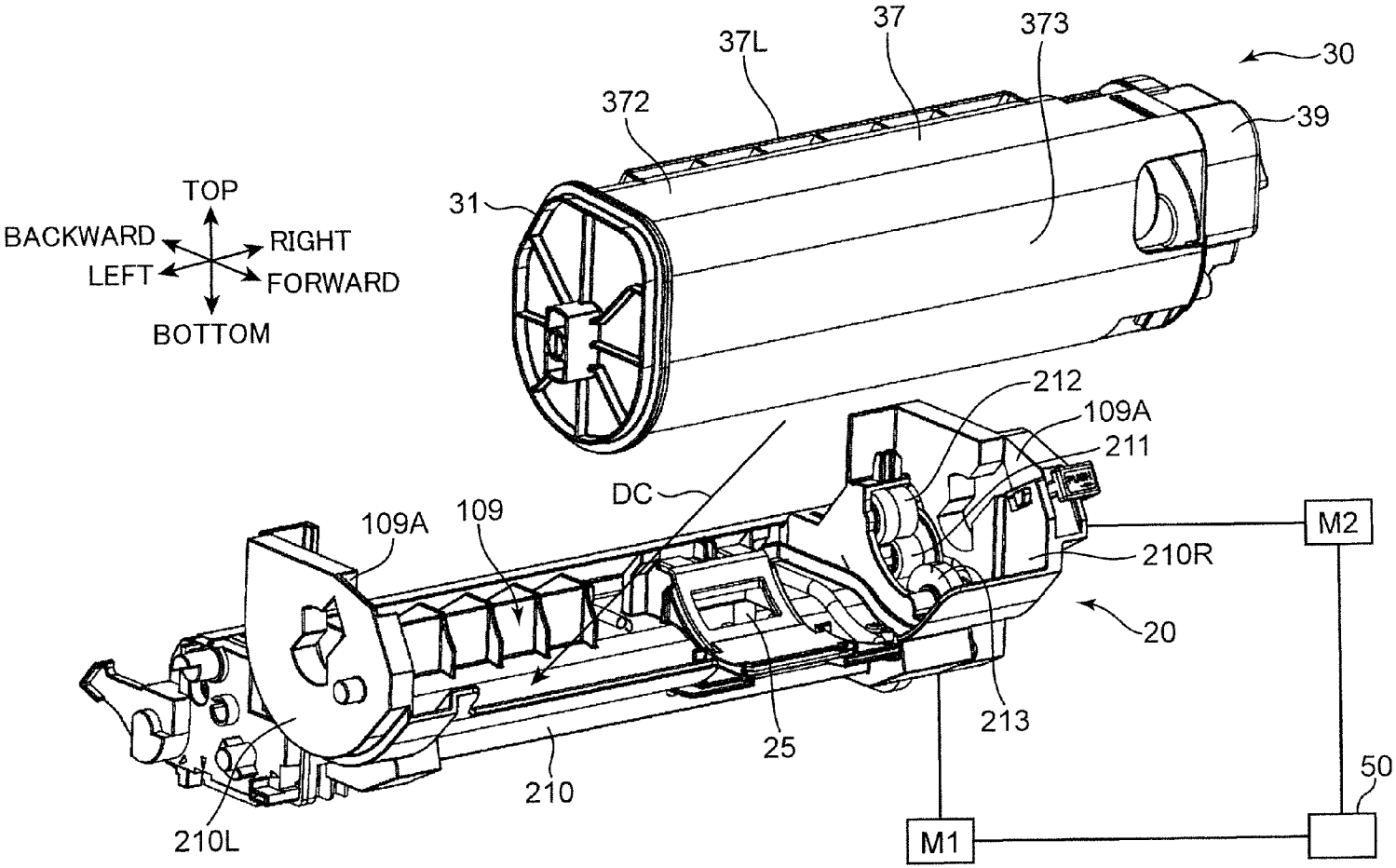
FIG. 7 is a perspective view of the developer container and the developing device according to the embodiment of the present disclosure.

FIGS. 6 and 7 are perspective views of the toner container 30 and the developing device 20 according to the present embodiment. The toner container 30 is detachable from the developing device 20 in the housing 101. With reference to FIG. 2, when the opening/closing cover 100C of the housing 101 is opened upward, a container housing space 109 in the development housing 210 of the developing device 20 is exposed to the outside of the housing 101. With reference to FIGS. 6 and 7, the development housing 210 includes a pair of a housing left wall 210L and a housing right wall 210R. The container housing space 109 is defined between the housing left wall 210L and the housing right wall 210R. In the present embodiment, the toner container 30 is attached to the container housing space 109 substantially from above (in the direction of an arrow DC shown in FIGS. 6 and 7). At this time, a cover 39 of the toner container 30 described later is disposed at the housing right wall 210R, and a lid 31 of the toner container 30 described later is disposed at the housing left wall 210L. The development housing 210 includes a pair of guide grooves 109A (FIG. 7). The guide grooves 109A are formed in the housing left wall 210L and the housing right wall 210R.

With reference to FIG. 7, the developing device 20 includes a first transmission gear 211, a second transmission gear 212, and a third transmission gear 213. The printer 100 includes a first motor M1, a second motor M2, and a controller 50 that are disposed in the housing 101. The first transmission gear 211, the second transmission gear 212, and the third transmission gear 213 are rotatably supported on the housing right wall 210R. The first transmission gear 211 is coupled to the second transmission gear 212. The first transmission gear 211 is coupled to the developing roller 21, the first stirring screw 23, and the second stirring screw 24 through unillustrated gears. When the developing device 20 is mounted into the housing 101, the first motor M1 is coupled to the third transmission gear 213, and the second motor M2 is coupled to the first transmission gear 211.

The first motor M1 causes a shaft 33 of the toner container 30 described later to rotate through the third transmission gear 213 so that a movable wall 32 of the toner container 30 described later moves. The second motor M2 causes the developing roller 21, the first stirring screw 23, and the second stirring screw 24 of the developing device 20 to rotate through the first transmission gear 211. The second motor M2 also causes a stirring member 35 of the toner container 30 described later through the first transmission gear 211 and the second transmission gear 212. In a printing operation of the printer 100, for example, the controller 50 controls the first motor M1 and the second motor M2 so as to drive components of the developing device 20 and the toner container 30.

<Structure of Toner Container>

Figures 8A, 8B:
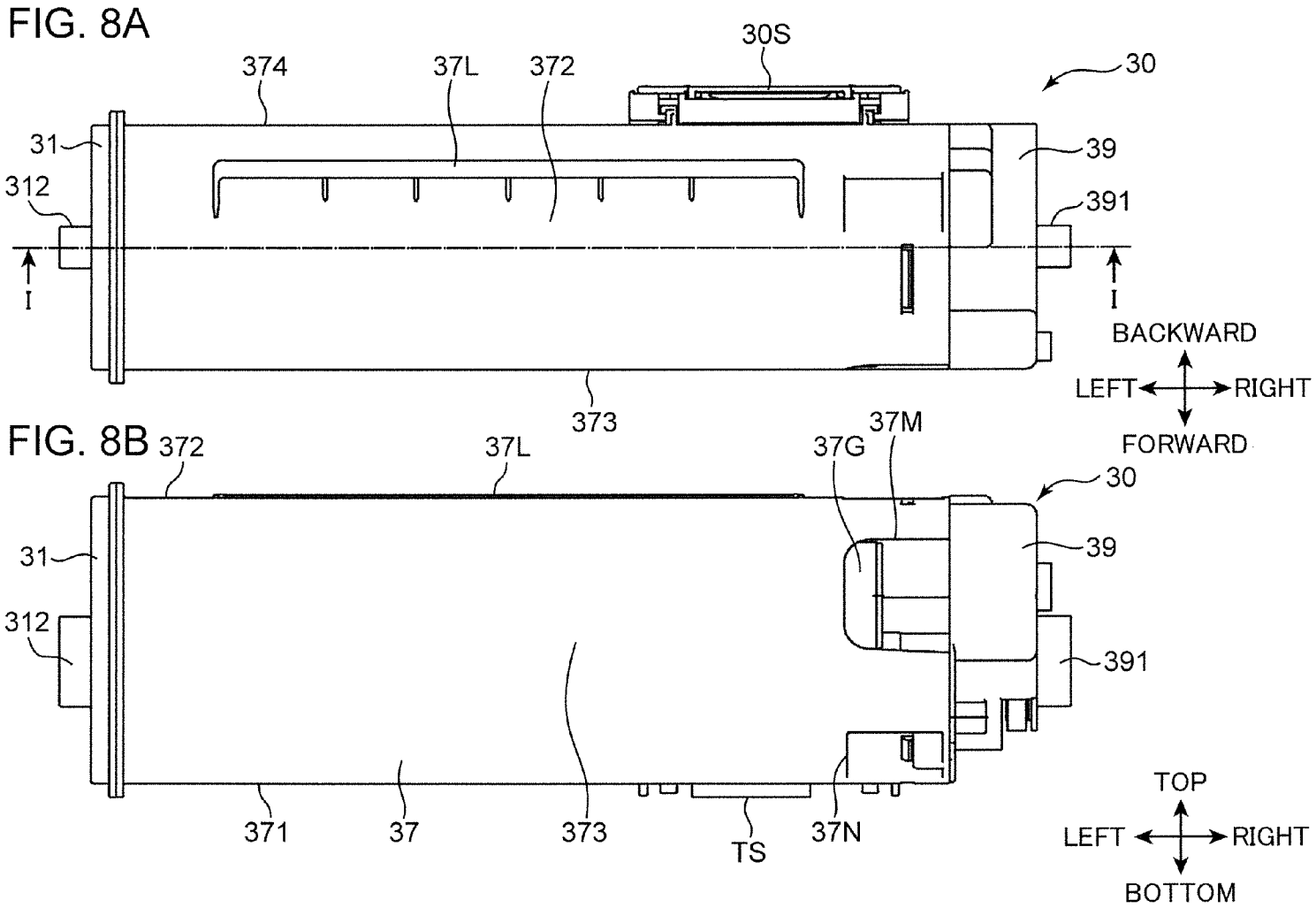
FIG. 8A is a plan view of the developer container according to the embodiment of the present disclosure.
FIG. 8B is a front view of the container.
Figure 9:
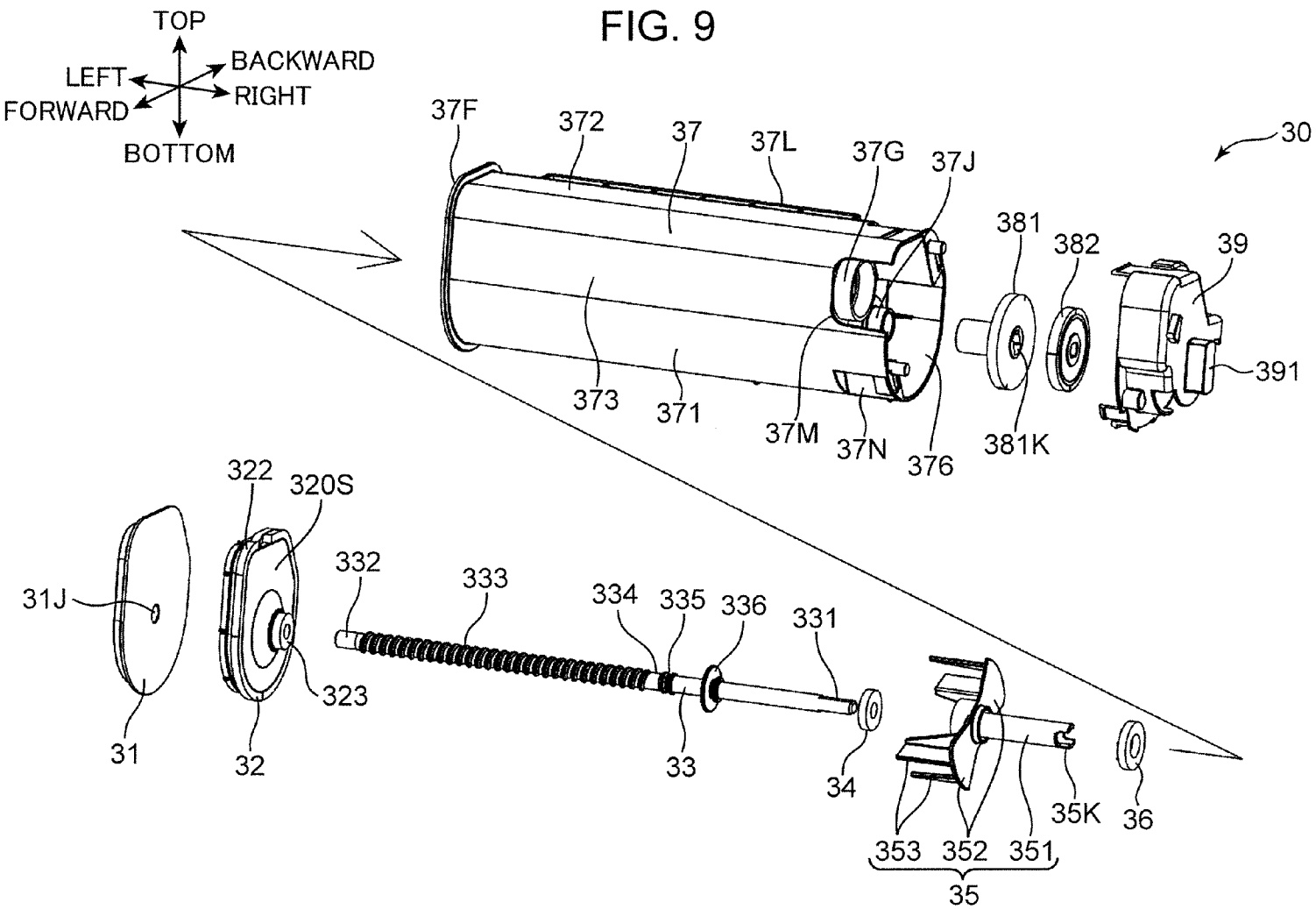
FIG. 9 is an exploded perspective view of the developer container according to the embodiment of the present disclosure.
Figure 10:
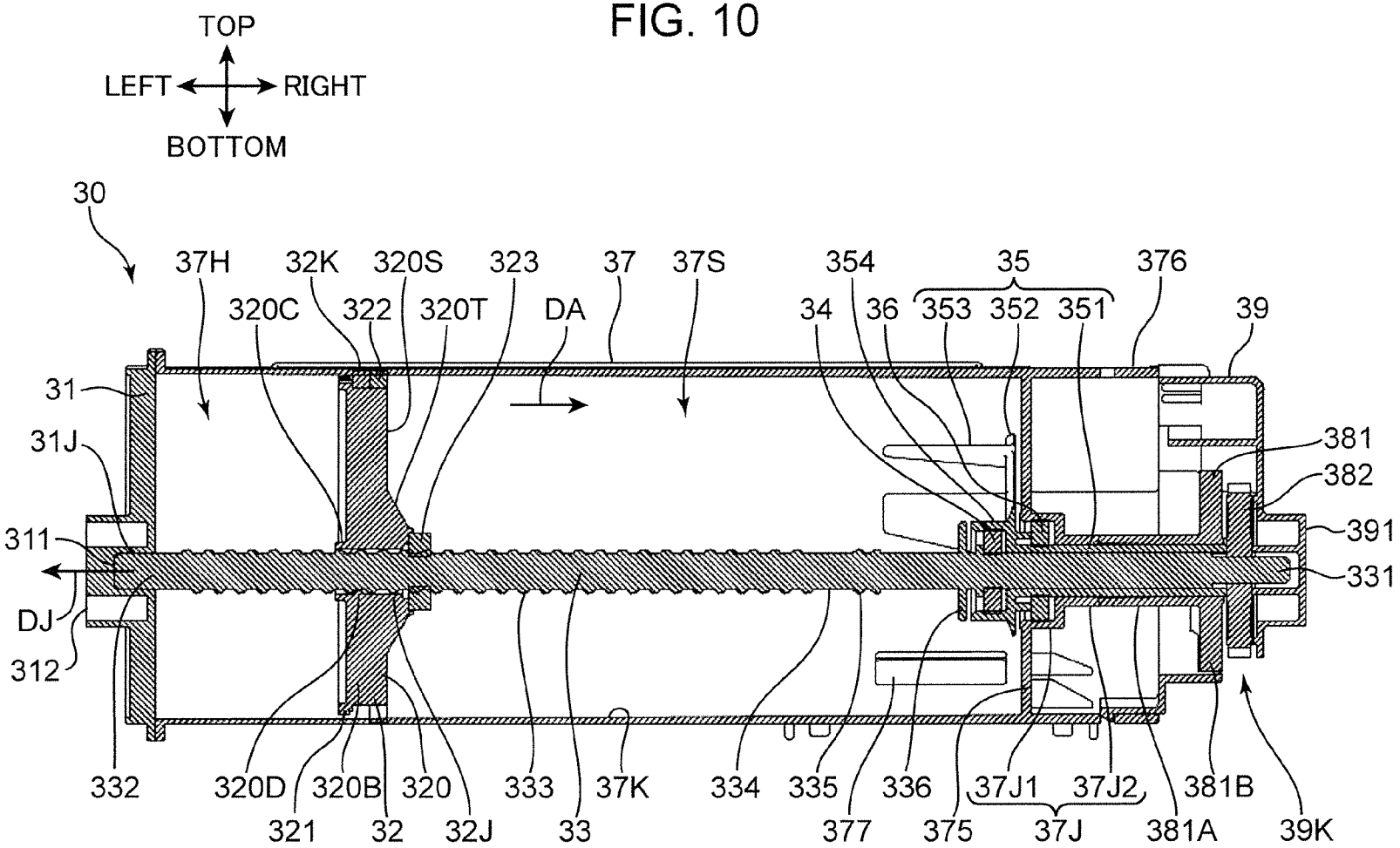
FIG. 10 is a sectional view of the developer container according to the embodiment of the present disclosure.
Figure 11:
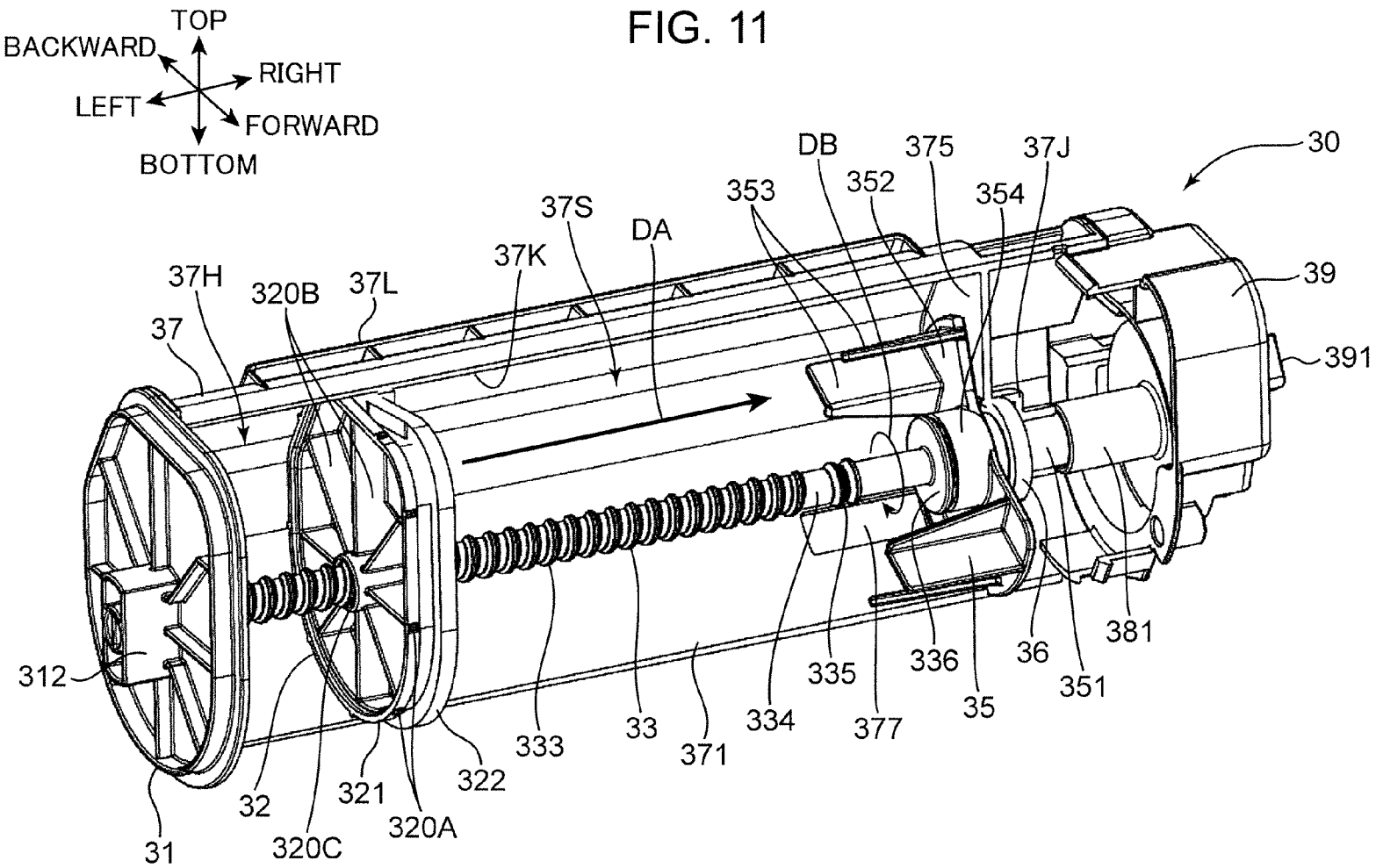
FIG. 11 is a perspective view showing the inside of the developer container according to the embodiment of the present disclosure.
Figure 12:
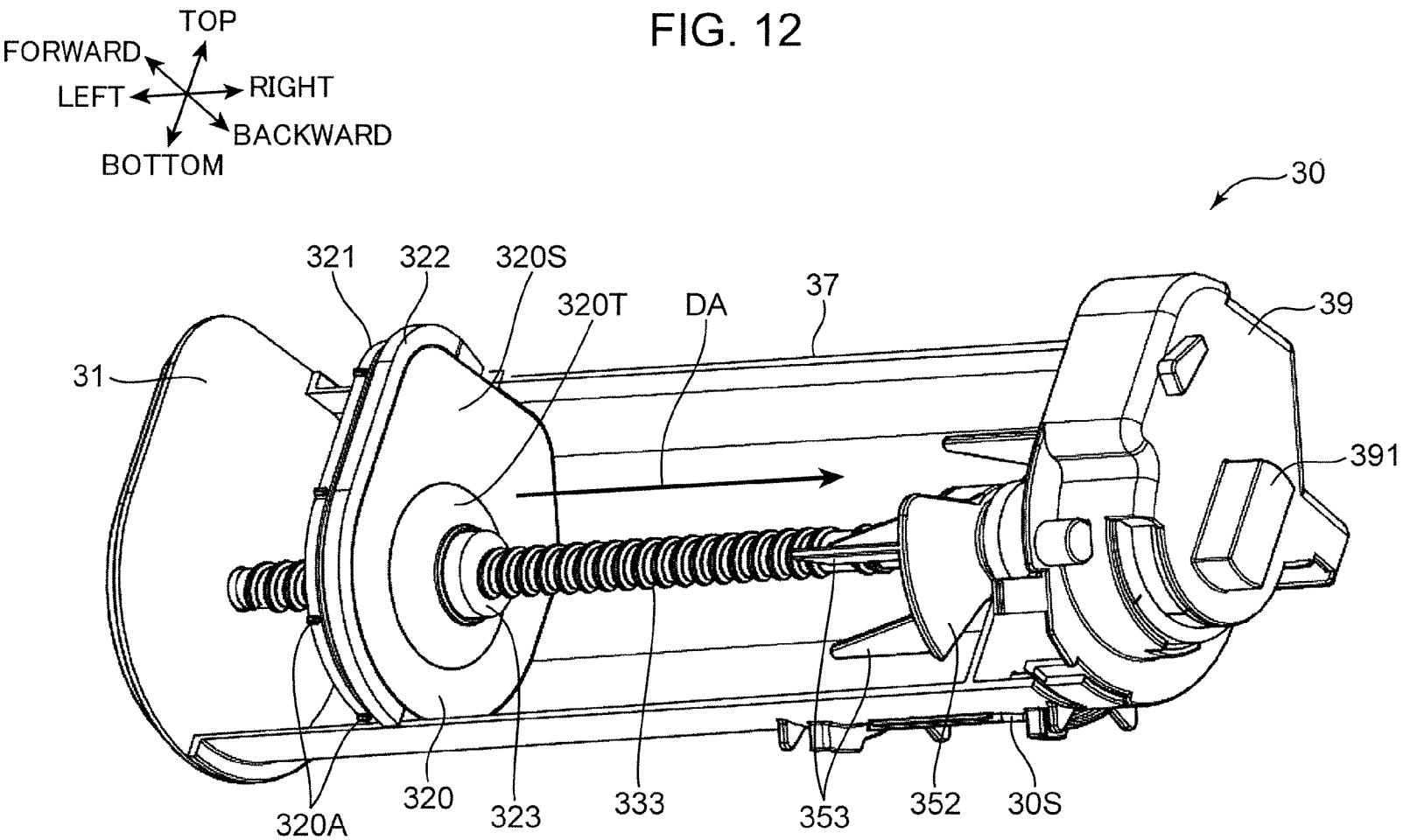
FIG. 12 is a perspective view showing the inside of the developer container according to the embodiment of the present disclosure.
Figure 13A:
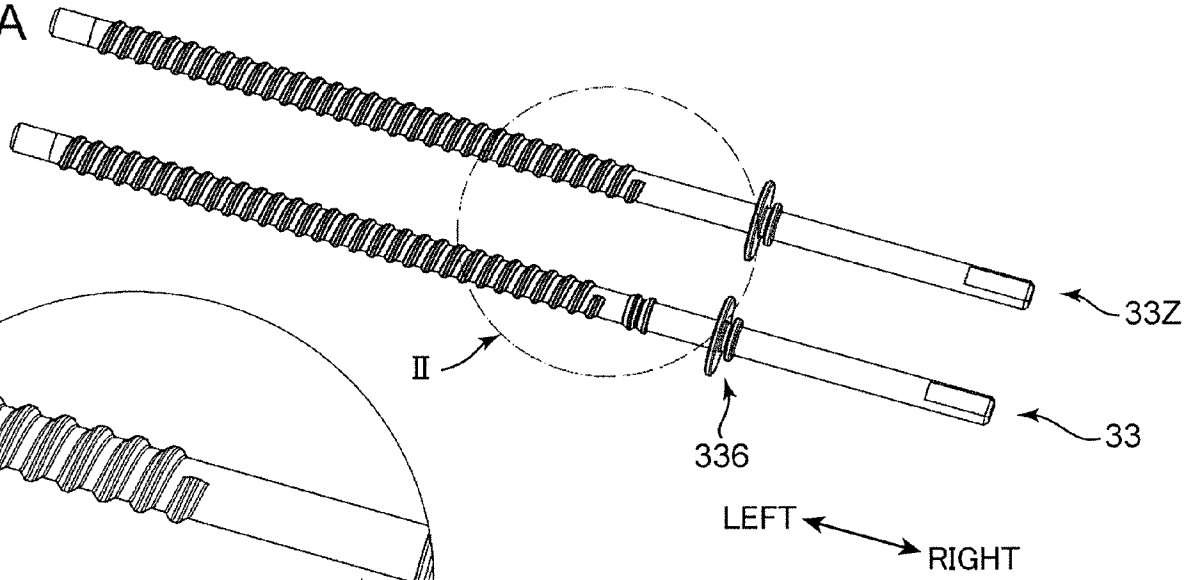
FIG. 13A is a perspective view of a shaft of the developer container according to the embodiment of the present disclosure.
Figure 13B:
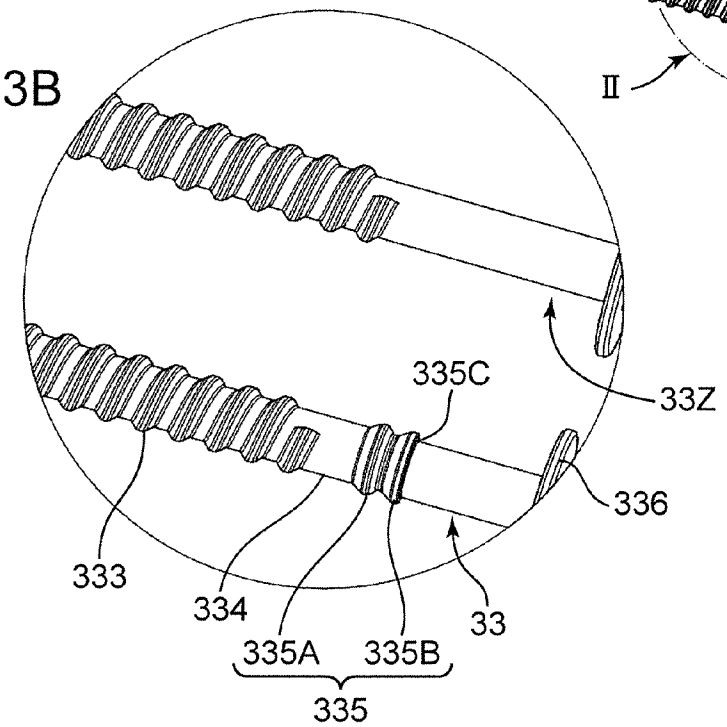
FIG. 13B is an enlarged perspective view of a part of FIG. 13A.
Figure 14:
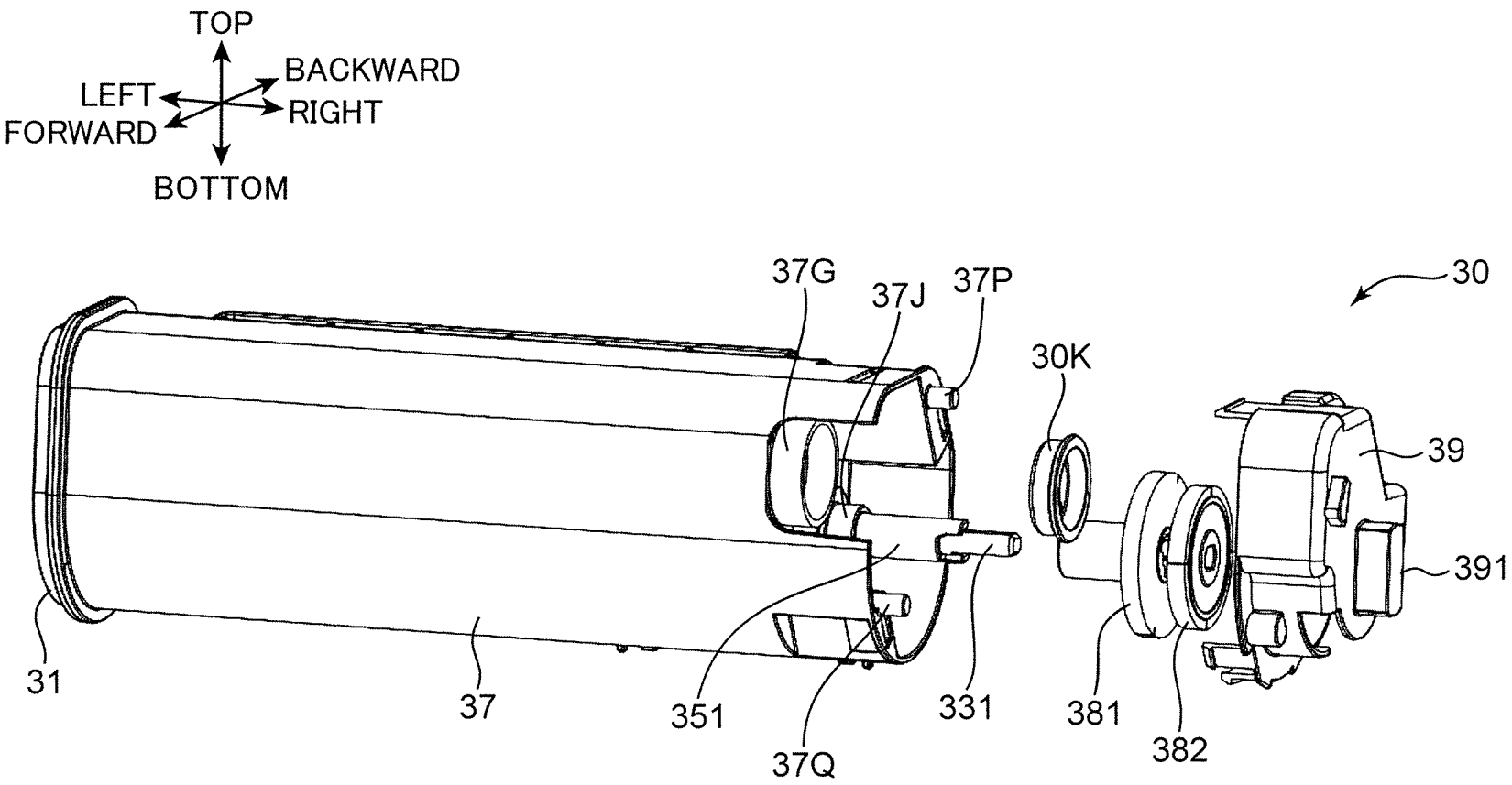
FIG. 14 is an exploded perspective view of the developer container according to the embodiment of the present disclosure.
Figure 15B:
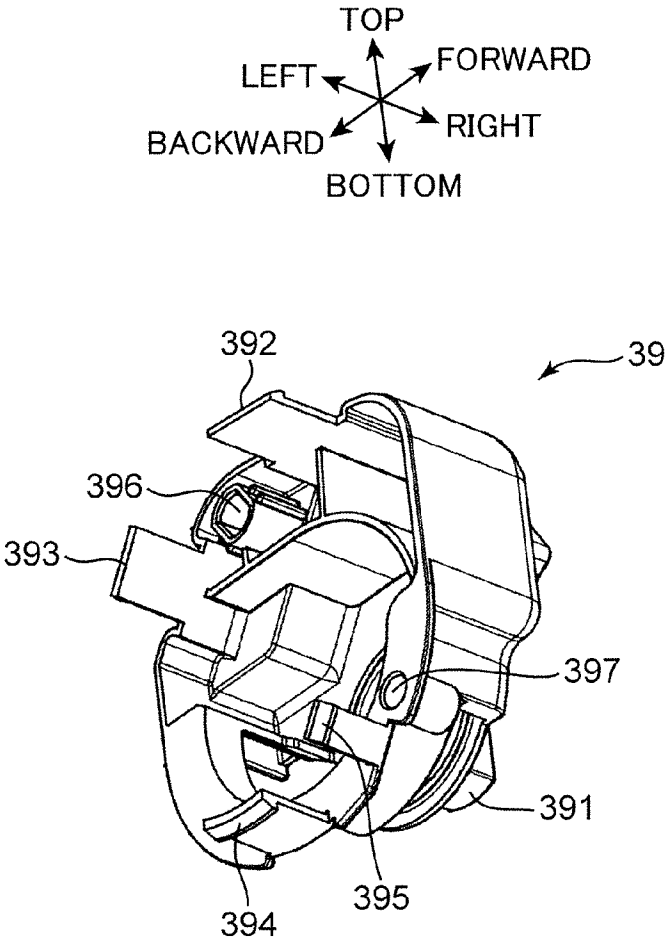
FIGS. 15A and 15B are perspective views of a cover member of the developer container according to the embodiment of the present disclosure.
Figure 15A:
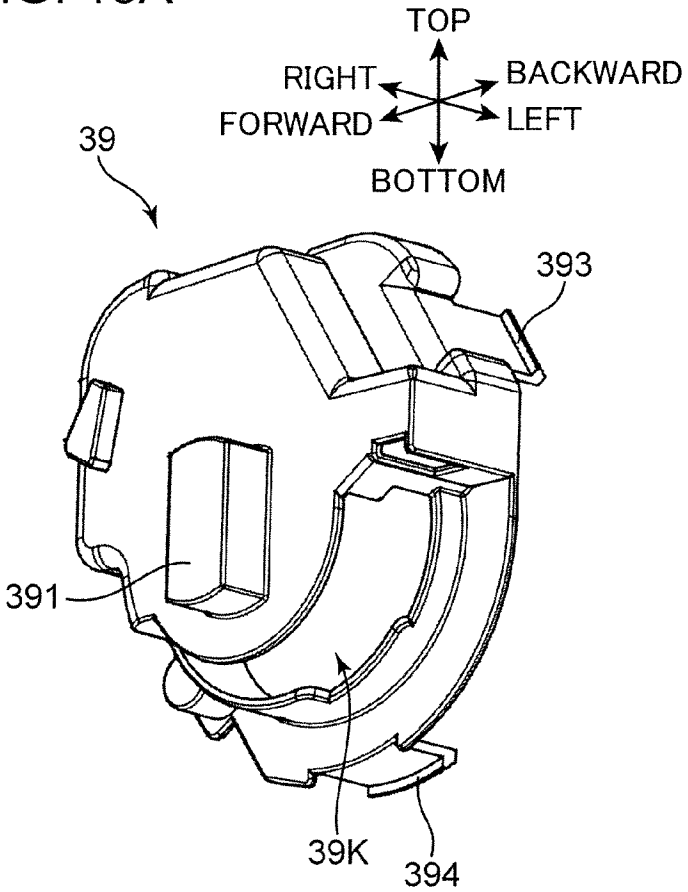
Figure 16A:
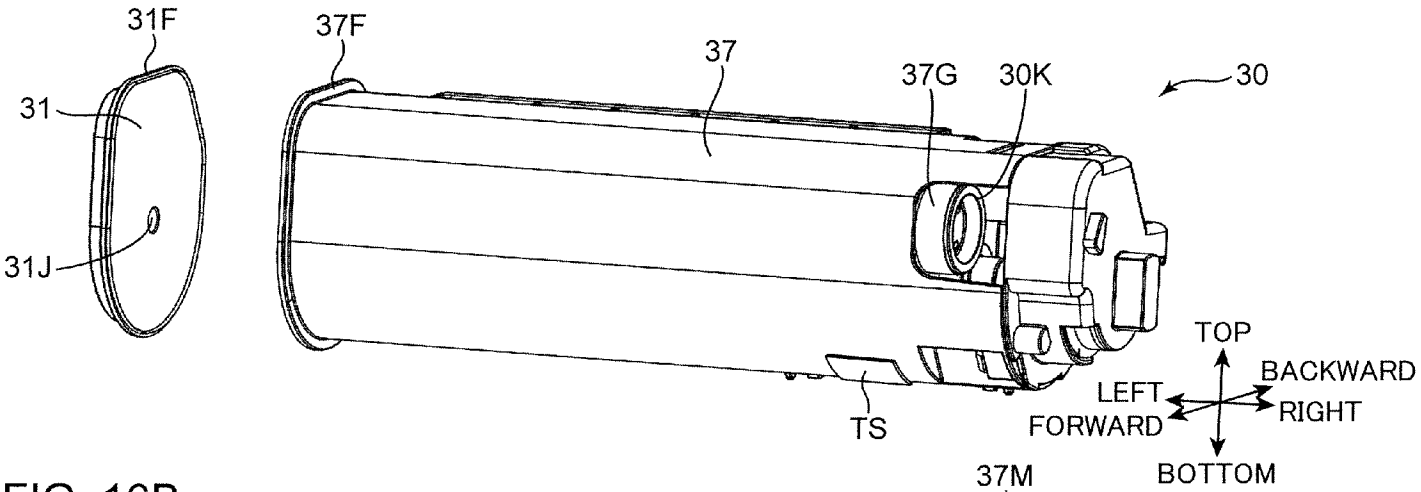
FIGS. 16A and 16B are exploded perspective views of the developer container according to the embodiment of the present disclosure.
Figure 16B:
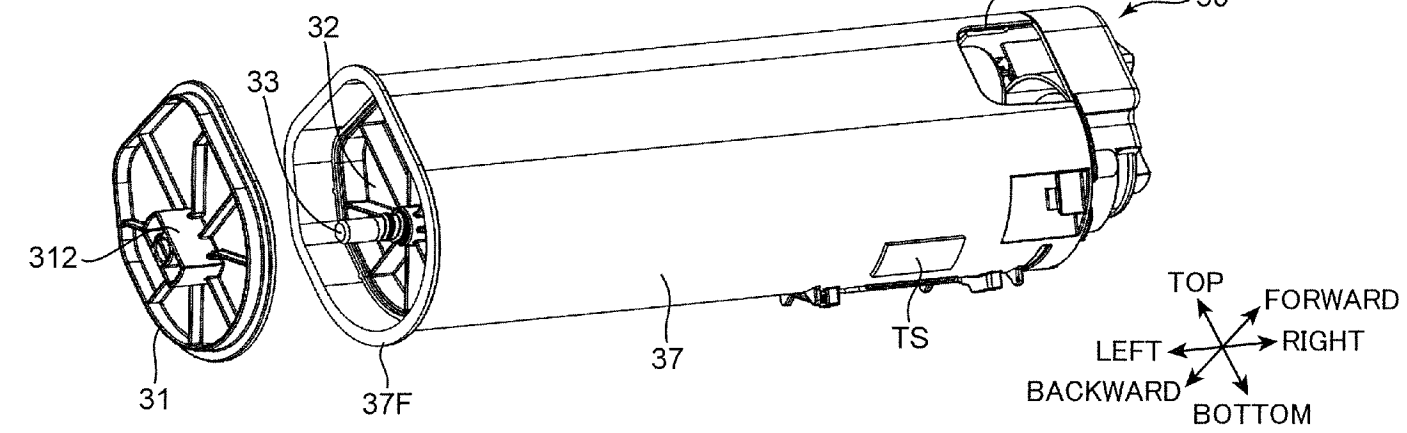

The toner container 30 (developer container) according to the embodiment of the present disclosure will now be described with reference to FIGS. 8A to 12. FIG. 8A is a plan view of the toner container 30 according to the present embodiment, and FIG. 8B is a front view of the toner container 30. FIG. 9 is an exploded perspective view of the toner container 30. FIG. 10 is a sectional view of the toner container 30 and shows a cross section I-I in FIG. 8A. FIGS. 11 and 12 are perspective views showing the inside of the toner container 30 according to the present embodiment. FIGS. 11 and 12 are perspective views in which a container body 37 of the toner container 30 described later is partially omitted. FIG. 13A is a perspective view of the shaft 33 provided in the toner container 30, and FIG. 13B is an enlarged perspective view of a region II shown in FIG. 13A. FIG. 14 is an exploded perspective view of the toner container 30. FIGS. 15A and 15B are perspective views of the cover 39 of the toner container 30. FIGS. 16A and 16B are exploded perspective views of the toner container 30.

The toner container 30 is in the form of a cylinder extending in the left-right direction (in a first direction, the direction of an arrow DA shown in FIG. 10). The toner container 30 contains replenishment toner (developer). With reference to FIG. 9, the toner container 30 includes the lid 31, the movable wall 32, the shaft 33, a first seal 34, the stirring member 35, a second seal 36, the container body 37 (container body), a filling port cap 30K (FIG. 14) (sealing member), a toner sensor TS (FIG. 16B), a first gear 381 (FIG. 9), a second gear 382 (transfer section), and the cover 39.

The lid 31 (FIGS. 9 and 10) is fixed to the container body 37 and seals an opening of the container body 37. The lid 31 includes a lid shaft hole 31J, a contact portion 311, and a first guide portion 312. The lid shaft hole 31J is disposed in a central part of the lid 31 and rotatably and axially supports the shaft 33. The lid shaft hole 31J is formed from the right side surface (inner side) of the lid 31 to the left to a predetermined length. The contact portion 311 corresponds to the bottom surface of the lid shaft hole 31J. An end surface of the shaft 33 is in contact with the contact portion 311. The contact portion 311 functions to control the position of the shaft 33 in the first direction. The first guide portion 312 (FIG. 11) is a projection vertically extending on the left side surface (outer side) of the lid 31. The first guide portion 312 functions to guide mounting of the toner container 30 into the developing device 20.

The container body 37 is a body part of the cylindrical toner container 30. The container body 37 includes an inner circumferential portion 37K (inner circumferential surface) and an internal space 37H (FIGS. 10 and 11). The inner circumferential portion 37K is an inner circumferential surface of the container body 37 and defines the internal space 37H in the form of a cylinder extending in a longitudinal direction (in the first direction, the direction of an arrow DA in FIGS. 10 and 11) of the toner container 30.

With reference to FIGS. 8A and 8B, the container body 37 includes the bottom portion 371, a top portion 372, a front wall 373, a rear wall 374, a right wall 375 (wall part) (FIG. 10), a body flange 37F (FIG. 9), and a projecting wall 376 (FIGS. 9 and 10). The bottom portion 371 constitutes the bottom of the container body 37 and is in the form of a half cylinder projecting downward. In other words, the bottom portion 371 has an arc shape in a sectional view perpendicularly intersecting the first direction. The front wall 373 and the rear wall 374 are a pair of side walls standing on the opposite lateral ends of the bottom portion 311. The top portion 372 is disposed above the bottom portion 371 to cover the internal space 37H from above. The right wall 375 joins one end (right end) of each of the bottom portion 371, the front wall 373, the rear wall 374, and the top portion 372 in the first direction, thereby covering the container body 37. The internal space 37H is defined by the inner circumferential portion 37K formed by the bottom portion 371, the top portion 372, the front wall 373, and the rear wall 374, and also by the right wall 375 and the lid 31. The right wall 375 defines one end surface of the internal space 37H in the first direction. The internal space 37H includes a storage space 37S defined between the right wall 375 and the movable wall 32. The storage space 37S is a space configured to contain toner in the toner container 30.

As shown in FIG. 10, the container body 37 is open at the end opposite to the right wall 375 in the first direction. The body flange 37F defines this opening and has an outer diameter slightly greater than the left end of the container body 37. When the lid 31 is fixed to the body flange 37F, the lid 31 covers the internal space 37H of the container body 37. A lid welded portion 31F (FIG. 16A) that is an outer peripheral edge of the lid 31 is ultrasonic welded (welded) to the body flange 37F.

With reference to FIGS. 9 and 10, the projecting wall 376 is a portion of an outer circumferential portion of the container body 37 projecting to the right relative to the right wall 375. The cover 39 is mounted on the projecting wall 376.

The container body 37 includes the toner discharge port 377 (developer discharge port), a shutter 30S, a grip 37L, a front notch 37M, a lower notch 37N, a filling port 37G (developer filling port), and a main body bearing 37J.

Toner discharge port 377 is formed in the bottom surface of the container body 37 and communicates with the inner circumferential portion 37K. As shown in FIGS. 10 and 11, the toner discharge port 377 is formed in a left end (an end in the first direction) of the container body 37. In other words, the toner discharge port 377 is disposed at an end of the container body 37 near the right wall 375.

The toner discharge port 377 has a predetermined length in the first direction and a predetermined width along the arc shape of the bottom portion 371, and is open in the form of a rectangle. In the present embodiment, the toner discharge port 377 is open at a position shifted rearward from a lower end of the bottom portion 371 in the circumferential direction.

Toner contained in the storage space 37S is discharged from the toner discharge port 377 toward the developing device 20. In the present embodiment, the bottom portion 371, the front wall 373, the rear wall 374, and the top portion 372 form the internal space 37H of the container body 37 as described above. Thus, toner in the storage space 37S is collected in the arc-shaped bottom portion 371 by its own weight, resulting in efficient discharge of toner conveyed by the movable wall 32 described later through the toner discharge port 377.

The shutter 30S (FIG. 6) is slidably disposed at the right end of the container body 37. The shutter 30S covers (seals) the toner discharge port 377 from the outside of the container body 37, and exposes the toner discharge port 377 to the outside. The shutter 30S slides in cooperation with mounting of the toner container 30 into the developing device 20.

The grip 37L (FIG. 9) is a projection projecting from a rear end of the top portion 372 of the container body 37 in the left-right direction. The grip 37L is gripped by a user. The front notch 37M is formed by laterally cutting out part of a front side surface of the projecting wall 376 to the left. The front notch 37M exposes the filling port 37G. The lower notch 37N is formed by recessing the side surface of a lower portion of the projecting wall 376 radially inward. The lower notch 37N is engaged with a fourth lug 395 (FIG. 15B) of the cover 39 described later.

The filling port 37G is in the form of a cylinder projecting from the right wall 375 to the right. The inside of the cylinder of the filling port 37G penetrates the right wall 375 in the first direction. The filling port 37G allows the outside of the container body 37 to communicate with the storage space 37S. The storage space 37S is filled with toner through the filling port 37G in fabrication of the toner container 30.

The main body bearing 37J is formed in the right wall 375. The main body bearing 37J is in the form of a cylinder projecting from the central part of the right wall 375 to the right. With reference to FIG. 10, the main body bearing 37J includes a large-diameter portion 37J1 and a small-diameter portion 37J2. The large-diameter portion 37J1 is a cylinder part projecting from the right wall 375 to the right. The small-diameter portion 37J2 is a cylinder part coupled to the right end of the large-diameter portion 37J1 and having a diameter smaller than that of the large-diameter portion 37J1. The shaft 33 is inserted into the main body bearing 37J. In this insertion, the right end of the shaft 33 projects to the outside of the container body 37. In addition, in the cylindrical shape of the main body bearing 37J, a part (stirring bearing member 351) of a stirring member 35 is inserted between the main body bearing 37J and the shaft 33.

The filling port cap 30K (FIG. 14) is mounted on the filling port 37G of the container body 37 to seal the filling port 37G. After the storage space 37S is filled with toner through the filling port 37G, the filling port cap 30K is mounted on the filling port 37G and welded thereto. Consequently, leakage of toner from the filling port 37G is prevented.

The movable wall 32 is disposed to intersect the first direction in the container body 37 (in the internal space 37H). The movable wall 32 defines an end surface (left end surface) of the storage space 37S in the first direction. The other end surface (right end surface) of the storage space 37S in the first direction is defined by the right wall 375. The movable wall 32 functions to move in the internal space 37H in the first direction from an initial position at one end to a terminal position at the other end in the first direction, while conveying toner in the storage space 37S toward the toner discharge port 377 in a period from the start to the end of using the toner container 30. In the present embodiment, the initial position of the movable wall 32 is disposed at the right (downstream side in the first direction) of the lid 31, and the terminal position is disposed immediately at the left (upstream side in the first direction) of the toner discharge port 377. The movable wall 32 is moved by a torque generated by the first motor M1. The lid 31 is disposed upstream of the movable wall 32 in the first direction. The right wall 375 is disposed downstream of the movable wall 32 in the first direction.

With reference to FIGS. 10 to 12, the movable wall 32 includes a conveying wall portion 320, an outer peripheral wall portion 321, guide ribs 320A (FIG. 12), inner ribs 320B (FIG. 11), a cylinder part 320C, an inner wall seal 322 (seal member), a shaft seal 323 (cleaning member), a bearing 32J (FIG. 10), and an outer circumferential portion 32K (outer circumferential surface).

The conveying wall portion 320 and the inner circumferential portion 37K of the container body 37 define the storage space 37S. In particular, the conveying wall portion 320 includes a conveying surface 320S extending perpendicularly to the shaft 33. The conveying surface 320S conveys toner in the storage space 37S by pressing the toner in accordance with the movement of the movable wall 32. In the present embodiment, the conveying surface 320S further includes a tapered surface 320T (FIGS. 10 and 12). The tapered surface 320T is a part of the conveying surface 320S that tilts toward the downstream side in the first direction so as to surround the shaft 33.

The bearing 32J is a bearing formed in a substantially central part of the conveying wall portion 320. The bearing 32J moves in the first direction while holding the movable wall 32. The shaft 33 described later is inserted into the bearing 32J.

The cylinder part 320C is a cylinder part of the conveying wall portion 320 projecting from the surface opposite to the conveying surface 320S toward the upstream side in the first direction. The cylinder part 320C constitutes a part of the bearing 32J. The cylinder part 320C includes a female helical portion 320D (second engaging portion). The female helical portion 320D is a helical thread formed on the inner circumferential surface of the cylinder part 320C. The female helical portion 320D functions to move the movable wall 32 in the first direction when being engaged with a male helical portion 333 of the shaft 33 described later. At this time, the inner wall of the cylinder part 320C comes into contact with the outer circumferential portion of the shaft 33, whereby the position of the movable wall 32 is maintained. This configuration prevents tilt of the conveying wall portion 320 of the movable wall 32 with respect to the shaft 33.

The outer peripheral wall portion 321 projects from the entire outer peripheral edge of the conveying wall portion 320 in a direction away from the storage space 37S, that is, toward the upstream side in the moving direction of the movable wall 32 (upstream side in the first direction). The outer peripheral wall portion 321 faces the inner circumferential portion 37K of the container body 37. The guide ribs 320A are rib members extending in the first direction on the outer peripheral wall portion 321. The guide ribs 320A are disposed on the circumferential surface of the outer peripheral wall portion 321 and spaced from one another in the circumferential direction of rotation of the shaft 33. The guide ribs 320A are in slight contact with the inner circumferential portion 37K of the container body 37, and functions to prevent the movable wall 32 from tilting with respect to the shaft 33 in the container body 37.

As shown in FIG. 11, the inner ribs 320B couple the outer circumferential surface of the cylinder part 320C to the inner circumferential surface of the outer peripheral wall portion 321. The inner ribs 320B are arranged in the circumferential direction. Since the sectional view of FIG. 10 is vertically taken and passes through the center of the shaft 33, some of the inner ribs 320B are connected to the conveying wall portion 320 in the sectional view.

The inner wall seal 322 is a seal member disposed near the conveying wall portion 320 of the outer peripheral wall portion 321 and covers the perimeter of the conveying wall portion 320. The inner wall seal 322 is an elastic member of urethane sponge. The tape-shaped inner wall seal 322 is fixedly attached to the top of the conveying wall portion 320 at a first end thereof, and then fixedly wound around the conveying wall portion 320 to be finally fixed at a second end thereof in such a manner that the first end and the second end overlap each other. The inner wall seal 322 is resiliently compressed between the inner circumferential portion 37K of the container body 37 and the movable wall 32. The inner wall seal 322 constitutes the outer circumferential portion 32K of the movable wall 32. The outer circumferential portion 32K is disposed in close contact with the inner circumferential portion 37K of the container body 37. The inner wall seal 322 prevents toner in the storage space 37S from flowing out to the upstream side of the movable wall 32 in the moving direction through the gap between the inner circumferential portion 37K of the container body 37 and the movable wall 32. The guide ribs 320A described above are disposed upstream of the inner wall seal 322 in the first direction.

In the bearing 32J, the shaft seal 323 is fixed at a position closer to the front end of the movable wall 32 in the moving direction than the female helical portion 320D is (FIG. 11). In particular, in the present embodiment, the shaft seal 323 is disposed at the front end of the tapered surface 320T of the conveying surface 320S. The shaft seal 323 is an elastic member of urethane sponge. The shaft seal 323 comes in contact with the male helical portion 333 of the shaft 33 in accordance with the movement of the movable wall 32. At this time, the shaft seal 323 comes in contact with the male helical portion 333 earlier than the female helical portion 320D to remove toner attached to the male helical portion 333. This allows the male helical portion 333 to be engaged with the female helical portion 320D after the attached toner is removed almost completely from the male helical portion 333. This makes it possible to prevent toner from aggregating between the male helical portion 333 and the female helical portion 320D and therefore to allow stable movement of the movable wall 32. In addition, the shaft seal 323 is in the form of a ring and is, therefore, in close contact with the shaft 33 over the entire circumference of the shaft 33. This prevents toner in the storage space 37S from flowing out to the upstream side of the movable wall 32 in the moving direction through the bearing 32J.

The shaft 33 extends in the internal space 37H in the first direction and is rotatably supported by the right wall 375 of the container body 37 and the lid 31. The shaft 33 includes a first shaft end 331, a second shaft end 332, the male helical portion 333 (first engaging portion), a movable wall stopper portion 334, a movable wall supporter portion 335, and a shaft flange 336.

With reference to FIGS. 9 and 10, the first shaft end 331 is defined by a right end (one end in the first direction) of the shaft 33. The first shaft end 331 is defined by a front end of the shaft 33 projecting to the right through the main body bearing 37J. As shown in FIG. 9, a pair of D planes is formed on the circumferential surface of the first shaft end 331. The first shaft end 331 is engaged with the second gear 382 having a D-hole shape at a central part thereof. Consequently, the shaft 33 and the second gear 382 are allowed to rotate as one unit. The front end of the first shaft end 331 penetrating the second gear 382 is disposed to enter the inside of the second guide portion 391 of the cover 39 described later. The second shaft end 332 is defined by a left end (the other end in the first direction) of the shaft 33. The second shaft end 332 is axially supported in the lid shaft hole 31J formed in the lid 31.

The male helical portion 333 is a helical thread formed on the outer circumferential surface of the shaft 33 in the first direction in the internal space 37H. In the present embodiment, the male helical portion 333 extends from a region of the shaft 33 adjacent to the lid 31 to a region upstream of the toner discharge port 377 in the first direction (in the arrow DA in FIG. 10), as shown in FIG. 10.

The movable wall stopper portion 334 is continuous to the downstream side of the male helical portion 333 in the first direction. The movable wall stopper portion 334 is the region of the shaft 33 that lies in the internal space 37H and is a discontinuous portion of the male helical portion 333 or only the outer circumferential surface. The movable wall stopper portion 334 is located above the toner discharge port 377 and upstream of the toner discharge port 377 in the first direction.

The movable wall supporter portion 335 is disposed downstream of the movable wall stopper portion 334 in the first direction. In other words, the male helical portion 333 and the movable wall supporter portion 335 are discontinuous in the first direction. The movable wall supporter portion 335 is a projection radially projecting from the circumferential surface of the shaft 33. As shown in FIG. 10, the movable wall supporter portion 335 is disposed above an upstream end of the toner discharge port 377 in the first direction. FIG. 13B is an enlarged perspective view showing the shaft 33 and a shaft 33Z. As described in a modified embodiment below, the shaft 33Z includes no movable wall supporter portion 335, with reference to the shaft 33 of the present embodiment.

The movable wall supporter portion 335 function to suppress tilt of the conveying surface 320S of the movable wall 32 with respect to the first direction (tilt with respect to the shaft 33) when the movable wall 32 comes to the terminal position. The movable wall supporter portion 335 is in the form of a ring extending in the circumferential direction on the circumferential surface of the shaft 33. In the present embodiment, the movable wall supporter portion 335 is formed by a plurality of (two) supporters disposed in the first direction. Specifically, the movable wall supporter portion 335 includes a first supporter 335A and a second supporter 335B (FIG. 13B). The first supporter 335A is a projection in the form of a ring at the upstream side in the first direction. The second supporter 335B is a projection in the form of a ring at the downstream side in the first direction. As shown in FIG. 13B, the first supporter 335A has an oblique surface sloping downward toward the upstream side and an oblique surface sloping downward toward the downstream side in the first direction from a ridge disposed substantially at a central part thereof in the first direction. On the other hand, the second supporter 335B has an oblique surface sloping upward toward the downstream side in the first direction and a side end surface 335C joined to the oblique surface. The side end surface 335C faces in the first direction and intersects perpendicularly the first direction.

The heights of the first supporter 335A and the second supporter 335B from the circumferential surface of the shaft 33 may be equal to the height of the male helical portion 333 or slightly larger than the height of the male helical portion 333.

The shaft flange 336 is spaced downstream from the movable wall supporter portion 335 in the first direction. The shaft flange 336 has the shape of a disc radially projecting from the circumferential surface of the shaft 33. As shown in FIGS. 9, 10, and 13A, the shaft flange 336 includes two discs disposed adjacently to each other in the first direction. One shaft flange 336 at the downstream side in the first direction has a diameter smaller than the other shaft flange 336 at the upstream side in the first direction. The downstream shaft flange 336 functions to compress the first seal 34 (FIG. 10) in cooperation with a stirring cylinder part 354 (FIG. 11) of the stirring member 35 described later. On the other hand, the upstream shaft flange 336 functions to prevent toner from entering the inside of the stirring cylinder part 354.

As described above, the first seal 34 is a ring-shaped seal member disposed between the shaft flange 336 of the shaft 33 and a side surface of the stirring cylinder part 354 of the stirring member 35 while being compressed by them. The first seal 34 is made of a sponge material. The first seal 34 prevents toner from leaking to the outside of the container body 37 through a gap between the inner circumferential surface of the stirring bearing member 351 (FIG. 10) of the stirring member 35 and the circumferential surface of the shaft 33.

The stirring member 35 (FIGS. 9 and 10) faces the right wall 375 above the toner discharge port 377. The stirring member 35 stirs toner in the storage space 37S. In the present embodiment, the stirring member 35 is independently rotatable around the shaft 33. In FIG. 11, the stirring member 35 rotates in the arrow DB direction. The stirring member 35 includes the stirring bearing member 351, stirring supporting portions 352, stirring blades 353 (blade parts), and the stirring cylinder part 354 (FIGA. 10 and 11).

The stirring bearing member 351 is in the form of a cylinder fitted on the shaft 33. The stirring bearing member 351 is inserted into the main body bearing 37J from the side of the container body 37 facing the storage space 37S. Consequently, the right end of the stirring bearing member 351 penetrates the main body bearing 37J and exposes to the outside of the container body 37 from the right wall 375 (the main body bearing 37J) (see FIG. 14). On the other hand, the left end of the stirring bearing member 351 is disposed in the storage space 37S. A first engaging portion 35K is formed in the right end of the stirring bearing member 351 (FIG. 9). The first engaging portion 35K is engaged with a second engaging portion 381K formed in the inner circumferential surface of the first gear 381. As a result, the stirring member 35 and the first gear 381 rotate as one unit.

The stirring supporting portions 352 each are in the form of a lug projecting from the left end of the cylindrical stirring bearing member 351 radially of the rotatable shaft 33. The stirring supporting portions 352 extend along the right wall 375 and face in the first direction. The stirring supporting portions 352 rotate around the shaft 33 in the storage space 37S. In particular, in the present embodiment, the stirring supporting portions 352 constitutes a pair. Specifically, one of the stirring supporting portions 352 (base blade) extends along the right wall 375 radially outward from the shaft 33. The other stirring supporting portion 352 (base blade) extends radially outward from a position different from the former stirring supporting portion 352 in the circumferential direction. In other words, the pair of stirring supporting portions 352 radially extend in the opposite directions and are disposed in a distance in a circumferential direction, and are each in the shape of a propeller whose width in the circumferential direction increases as advancing radially outward. Thus, as compared to a configuration having stirring supporting portions 352 in the form of a disc, the present embodiment more facilitates moving of toner out of the gap between the stirring supporting portions 352 and the right wall 375, thus preventing aggregation of toner.

The stirring blades 353 are blade members projecting from the pair of stirring supporting portions 352 to the left (to the upstream side in the first direction). As shown in FIGS. 11 and 12, the two stirring blades 353 project from the stirring supporting portions 352, respectively. Each of the stirring blades 353 has an L-shape in a cross section perpendicular to the axial direction of the shaft 33 (see FIG. 17B). The stirring blades 353 stir toner around the toner discharge port 377 while moving above the toner discharge port 377, and cause toner to be discharged from the toner discharge port 377.

The stirring cylinder part 354 is on the region of the stirring bearing member 351 that is on the left side of the stirring supporting portions 352. The outer diameter of the stirring cylinder part 354 is larger than that of the stirring bearing member 351 on the right side of the stirring supporting portion 352. As shown in FIG. 10, the first seal 34 is compressedly placed in the stirring cylinder part 354.

The second seal 36 is a ring-shaped seal member disposed in the large-diameter portion 37J1 of the container body 37. The second seal 36 is compressedly placed between a ring-shaped projection formed on the right side surface of the stirring supporting portions 352 of the stirring member 35 and a stepped portion between the large-diameter portion 37J1 and the small-diameter portion 37J2 of the main body bearing 37J. The second seal 36 is made of a sponge material. The second seal 36 prevents toner from leaking to the outside of the container body 37 through the gap between the outer circumferential surface of the stirring bearing member 351 of the stirring member 35 and the inner circumferential surface of the main body bearing 37J.

The first gear 381 transfers a torque to the stirring member 35. The first gear 381 is coupled to the second motor M2 through the first transmission gear 211 and the second transmission gear 212 (FIG. 7). The first gear 381 is coupled to the stirring bearing member 351 of the stirring member 35 penetrating the main body bearing 37J. The first gear 381 includes a gear cylinder part 381A in the form of a cylinder and a first gear part 381B (FIG. 10).

The gear cylinder part 381A is a cylinder part fitted on the stirring bearing member 351 of the stirring member 35. As described above, the gear cylinder part 381A is coupled to the stirring bearing member 351 by coupling the first engaging portion 35K (FIG. 9) of the stirring member 35 to the second engaging portion 381K of the first gear 381. As a result, the first gear 381 and the stirring member 35 rotate as one unit.

The first gear part 381B is a gear disposed at the right end of the gear cylinder part 381A. The first gear part 381B has an outer diameter larger than that of the gear cylinder part 381A. The first gear part 381B has a number of gear teeth on the circumferential surface thereof The second gear 382 transfers a torque to the shaft 33. The second gear 382 also has a number of gear teeth on the circumferential surface thereof. The second gear 382 is coupled to the first motor M1 through the third transmission gear 213 (FIG. 7). As shown in FIG. 10, the right end of the shaft 33 penetrates the stirring bearing member 351 of the stirring member 35. The second gear 382 is coupled (fixed) to the front end (first shaft end 331) penetrating the stirring bearing member 351 of the shaft 33. As shown in FIG. 10, the side surface of the second gear 382 faces the front end of the stirring bearing member 351 of the stirring member 35. The second gear 382 is adjacent to the first gear part 381B in the first direction. The first gear 381 and the second gear 382 are disposed downstream of the movable wall 32 in the moving direction thereof (in the first direction).

In other words, as shown in FIG. 10, the first gear 381 and the second gear 382 are collectively disposed at a position facing the right wall 375 of the container body 37 outside the container body 37. Thus, the entire toner container 30 can be configured in small size especially in the first direction. In addition, the necessity of forming shaft holes through both of the lid 31 and the right wall 375 is removed. Thus, leakage of toner (developer) and decrease in rigidity of the lid 31 and the right wall 375 are suppressed. In the present embodiment, the shape of the first gear 381 including the gear cylinder part 381A allows the first gear 381 and the second gear 382 to be disposed adjacent to each other. Thus, driving parts (the first transmission gear 211, the second transmission gear 212, and the third transmission gear 213) for applying a driving force to the first gear 381 and the second gear 382 are collectively disposed in the developing device 20.

The cover 39 is mounted on the projecting wall 376 of the container body 37. The cover 39 allows parts of the first gear 381 and the second gear 382 in the circumferential direction to be exposed to the outside, and encloses the other parts of the first gear 381 and the second gear 382 in the circumferential direction. With reference to FIGS. 15A and 15B, the cover 39 includes the second guide portion 391, a first lug 392, a second lug 393, a third lug 394, a fourth lug 395, a first hole 396, a second hole 397, and a gear opening 39K.

The second guide portion 391 is in the form of a projection projecting to the right and extending vertically on the right side surface of the cover 39. The second guide portion 391 functions to guide mounting of the toner container 30 into the developing device 20 in cooperation with the first guide portion 312 of the lid 31. As shown in FIG. 10, the front end of the first shaft end 331 penetrating the second gear 382 is housed in the second guide portion 391.

The first lug 392, the second lug 393, the third lug 394, and the fourth lug 395 project to the left from the outer peripheral edge of the cover 39. These lugs are used as snap-fits for mounting the cover 39 on the container body 37. The first hole 396 and the second hole 397 are formed near the outer peripheral edge on the left side surface of the cover 39. On the other hand, with reference to FIG. 14, the container body 37 further includes a first stud 37P and a second stud 37Q each in the form of a pin projecting to the right. When the cover 39 is mounted on the container body 37, the first stud 37P and the second stud 37Q are inserted into the first hole 396 and the second hole 397, respectively, thereby defining the position of the cover 39 in the circumferential direction.

As shown in FIG. 15A, the gear opening 39K is opened in the shape of a semi-arc in a lower portion of the cover 39. When the cover 39 is mounted on the container body 37, some of the gear teeth of the first gear 381 and the second gear 382 are exposed to the outside of the toner container 30 through the gear opening 39K. Consequently, when the toner container 30 is mounted into the development housing 210 of the developing device 20, the first gear 381 and the second gear 382 are respectively engaged with the second transmission gear 212 and the third transmission gear 213 (FIG. 7). In this manner, the presence of the gear opening 39K enables a torque to be applied to the first gear 381 and the second gear 382 with protection of the first gear 381 and the second gear 382.

The toner sensor TS (FIGS. 8B and 16B) is a sensor disposed on the bottom portion 371 of the container body 37. The toner sensor TS is disposed adjacently to the toner discharge port 377 in the circumferential direction, and attached to a lowest section of the bottom portion 371 in the present embodiment. The toner sensor TS is made of a magnetic permeability sensor or a piezoelectric element. In the configuration where the toner sensor TS is made of a piezoelectric element, a sensing portion of the toner sensor TS is exposed to the storage space 37S. The toner sensor TS outputs a HIGH signal (+5V) when being pressed by toner in the storage space 37S. Further, when almost no toner exists above the toner sensor TS, the toner sensor TS outputs a LOW signal (0V). A signal output from the toner sensor TS is received by a controller 50 (FIG. 7). In the configuration where the toner sensor TS is made of a magnetic permeability sensor, the sensor does not need to make direct contact with toner. Therefore, in other embodiment, a toner sensor TS may be disposed on the development housing 210 of the developing device 20 in such a manner as to face the outer wall of the container body 37. Further, the toner sensor TS is not limited to be disposed on the bottom portion 371. In other embodiment, a toner sensor may be disposed on any one of the top portion 372, the front wall 373, and the rear wall 374 of the container body 37, for example.

<Assembly of Toner Container>

A procedure of assembly of the toner container 30 will now be briefly described. With reference to FIG. 9, the first seal 34 is inserted from the first shaft end 331 of the shaft 33. The first seal 34 comes in contact with the shaft flanges 336. On the other hand, the second seal 36 is placed on the stirring bearing member 351 of the stirring member 35. The second seal 36 comes into contact with the ring-shaped projection on respective proximal ends of the stirring supporting portions 352. In addition, the first shaft end 331 of the shaft 33 is inserted into the stirring bearing member 351 of the stirring member 35. Then, the movable wall 32 is inserted from the second shaft end 332 of the shaft 33. Since the female helical portion 320D of the movable wall 32 is engaged with the male helical portion 333 of the shaft 33, the movable wall 32 is mounted on the shaft 33 while rotating the movable wall 32 several turns. The first shaft end 331 of the shaft 33 is inserted into the internal space 37H through the body flange 37F of the container body 37 with the movable wall 32, the shaft 33, the first seal 34, the stirring member 35, and the second seal 36 being integrated. As shown in FIG. 14, the first shaft end 331 penetrates the main body bearing 37J and projects from the right end of the container body 37. Thereafter, with reference to FIG. 16A, the lid welded portion 31F of the lid 31 is ultrasonic welded to the body flange 37F of the container body 37. Consequently, the internal space 37H and the storage space 37S are formed in the container body 37. The storage space 37S is filled with toner in the state of the filling port 37G of the container body 37 being opened.

<Filling with Developer>

Figure 17A:
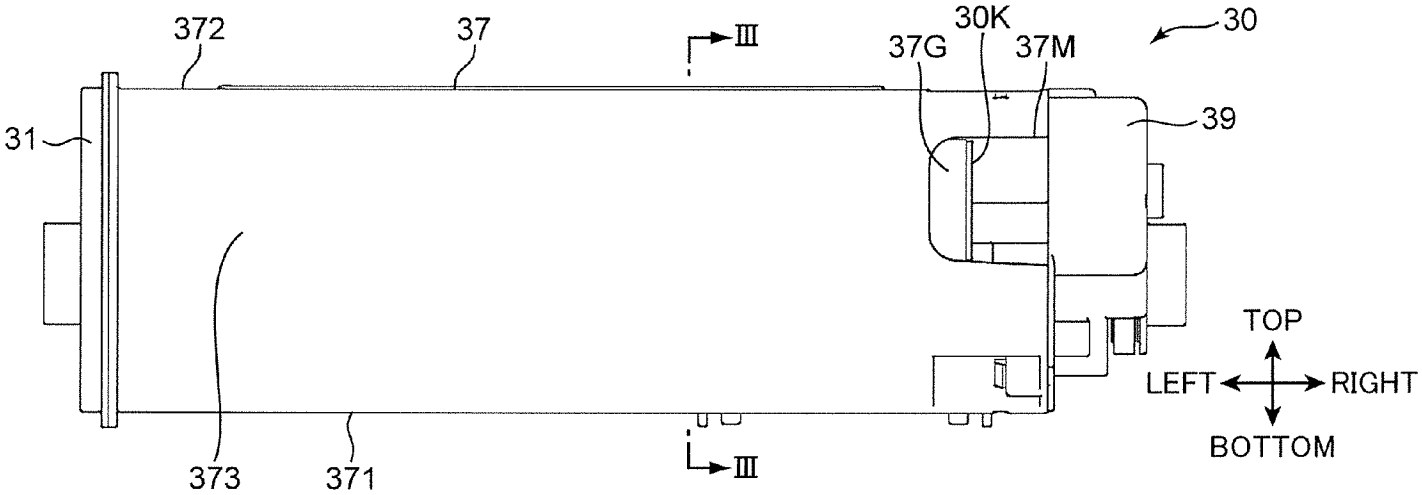
FIG. 17A is a front view of the developer container according to the embodiment of the present disclosure.
Figure 17B:
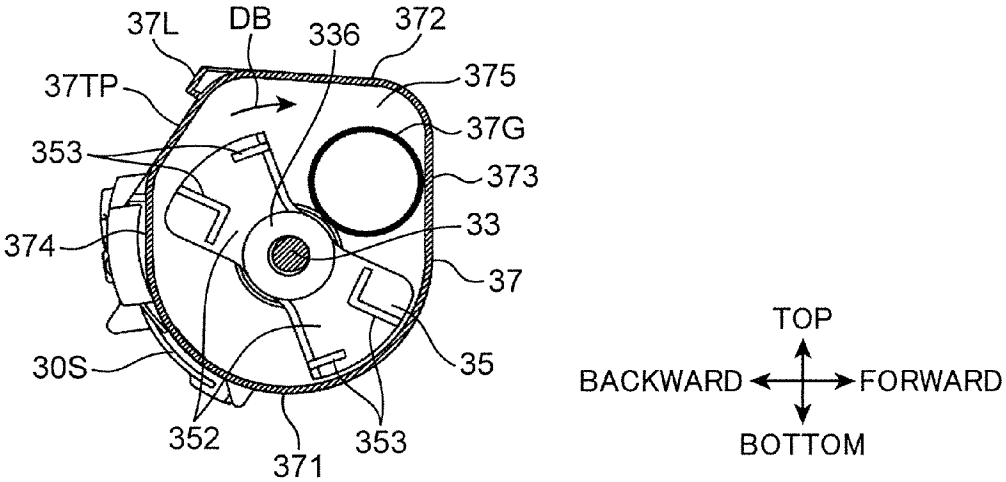
FIG. 17B is a sectional view of the container.
Figure 18A:
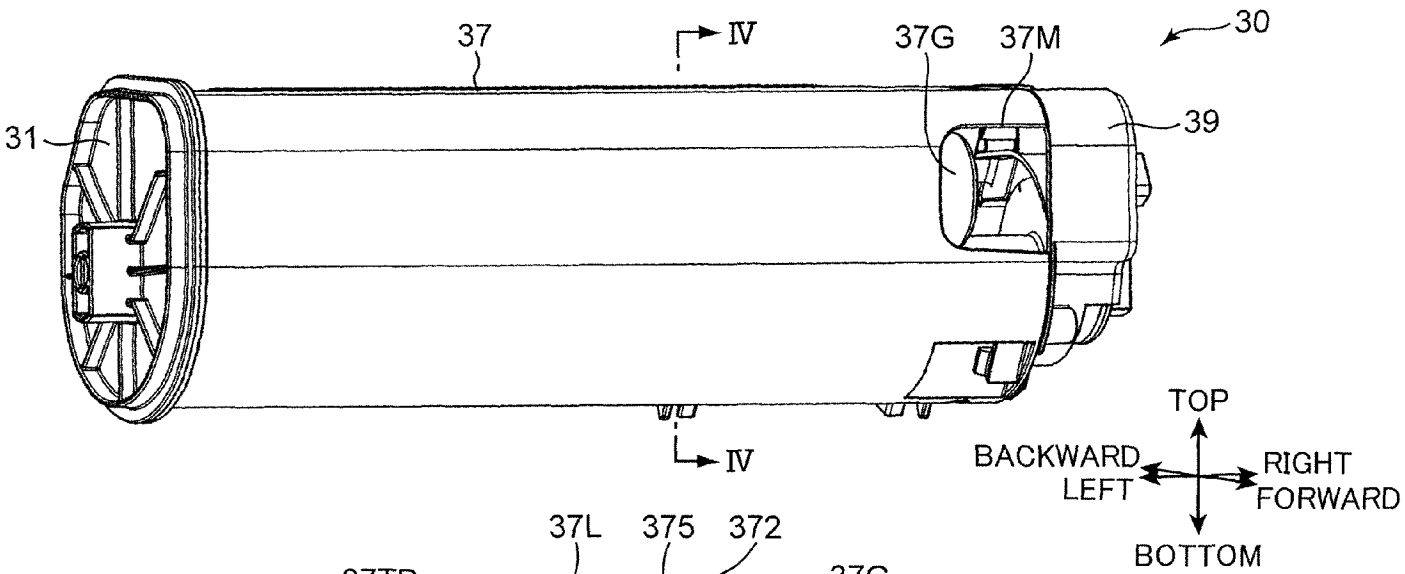
FIG. 18A is a perspective view of the developer container according to the embodiment of the present disclosure.
Figure 18B:
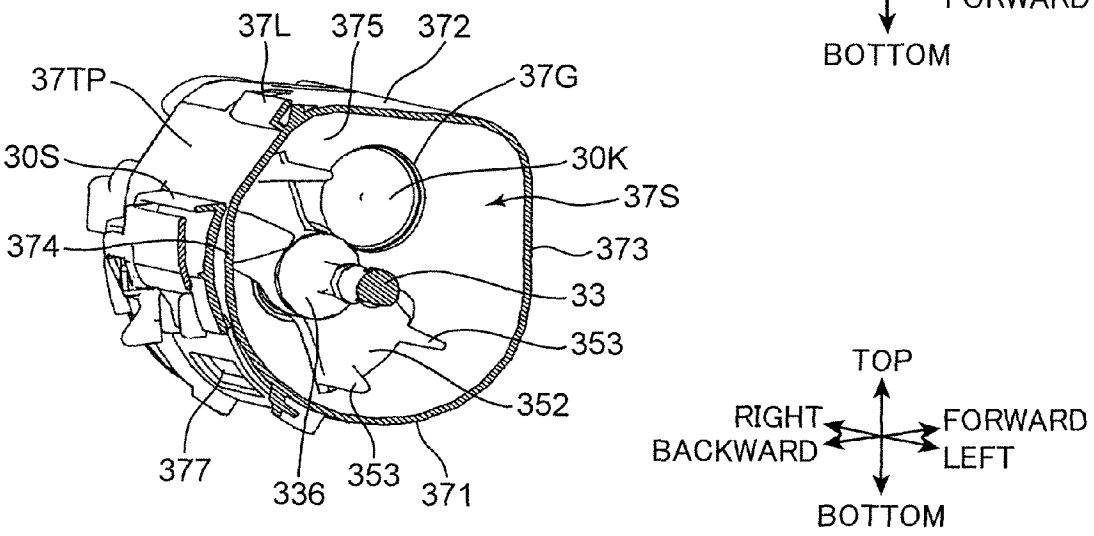
FIG. 18B is a sectional perspective view of the container.

FIG. 17A is a front view of the toner container 30 according to the present embodiment, and FIG. 17B is a sectional view of the toner container 30. FIG. 17B is a sectional view and corresponds to a cross section III-III in FIG. 17A. FIG. 18A is a perspective view of the toner container 30, and FIG. 18B is a sectional perspective view of the toner container 30. The sectional perspective view of FIG. 18B includes a cross section IV-IV in FIG. 18A.

With reference to FIGS. 17A, 17B, and 18B, in the present embodiment, the stirring member 35 exposes the filling port 37G when the stirring member 35 is at a predetermined rotational position around the shaft 33 in view of the right wall 375 from upstream in the first direction (from the left side, i.e., the front side in the drawing sheet of FIG. 17B) in the internal space 37H. Specifically, as shown in FIG. 17B, when the stirring member 35 is located at the predetermined rotational position around the shaft 33, the filling port 37G is exposed between one stirring supporting portion 352 and the other stirring supporting portion 352. Thus, even in the configuration where the stirring member 35 is rotatable over a plane in parallel with the right wall 375, the storage space 37S can be smoothly filled with toner through the filling port 37G at the designed rotational position of the stirring member 35 as shown in FIGS. 17B and 18B.

Figure 21A:
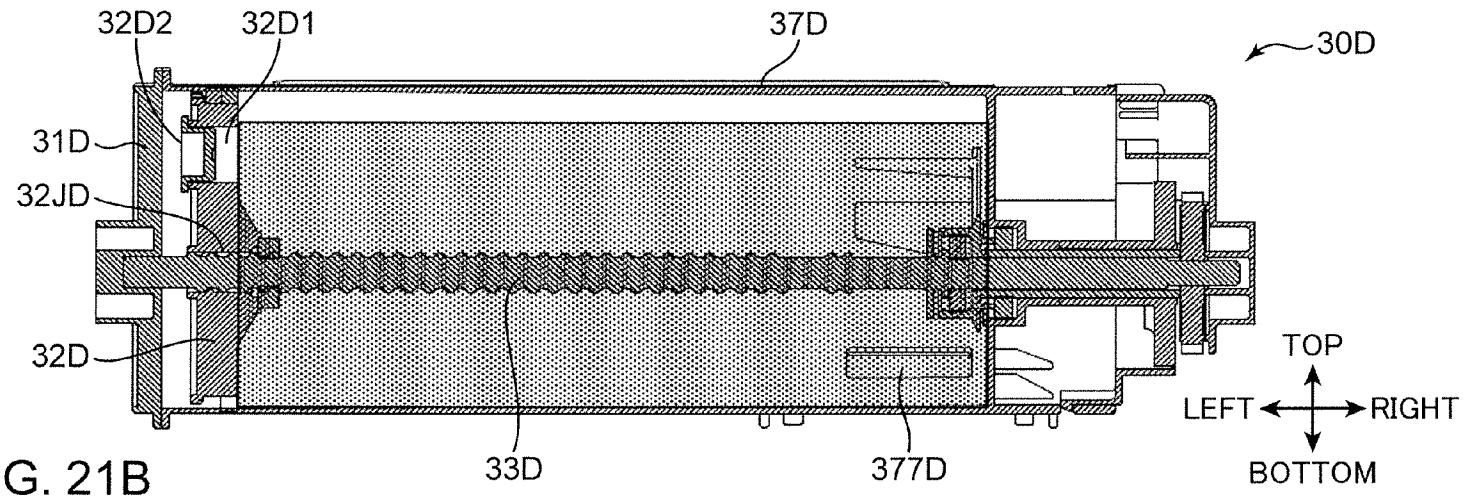
FIGS. 21A and 21B are sectional views of another developer container for comparison with the developer container according to the embodiment of the present disclosure.
Figure 21B:
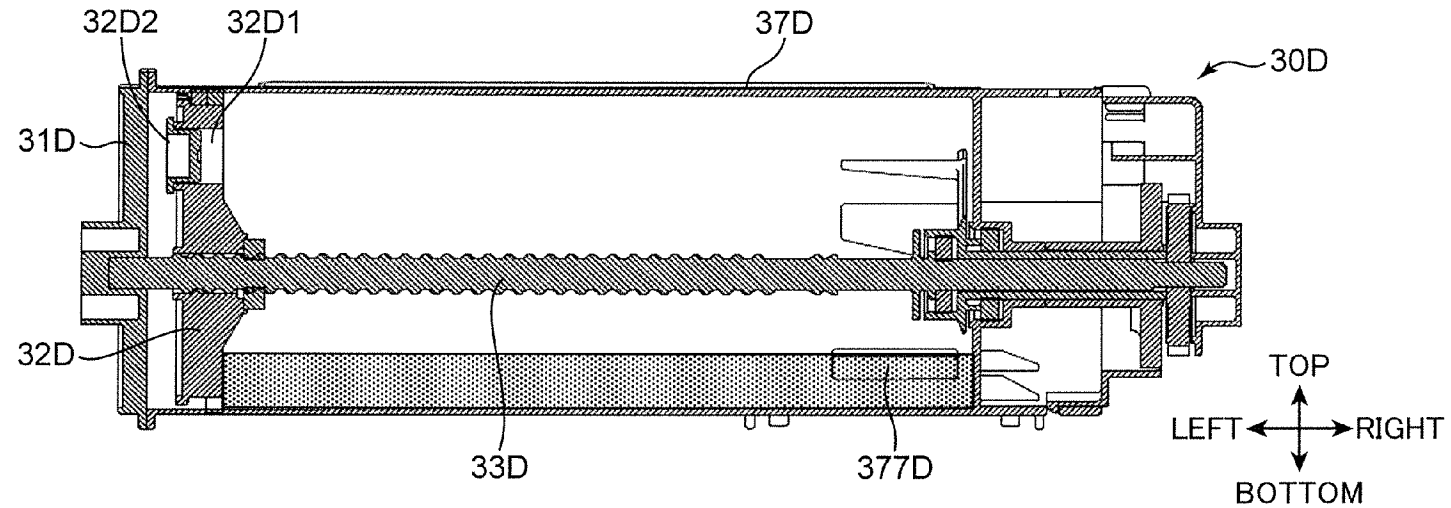

In addition, as described above, the filling port 37G for filling the storage space 37S with toner is formed in the right wall 375 in the present embodiment. FIGS. 21A and 21B are sectional views of another toner container 30D for comparison with the toner container 30 according to the present embodiment. Similarly, FIG. 22A is a sectional view of the toner container 30D, and FIG. 22B is a sectional view of another toner container 30E for comparison with the toner container 30 according to the present embodiment.

Figure 22A:
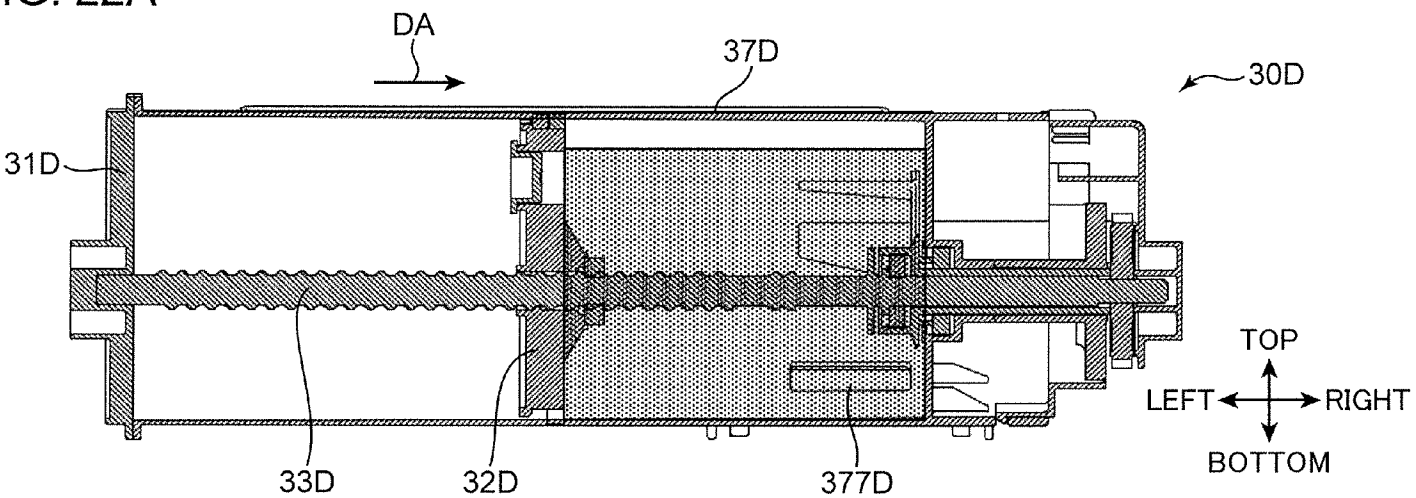
FIGS. 22A and 22B are sectional views of another developer container for comparison with the developer container according to the embodiment of the present disclosure.
Figure 22B:
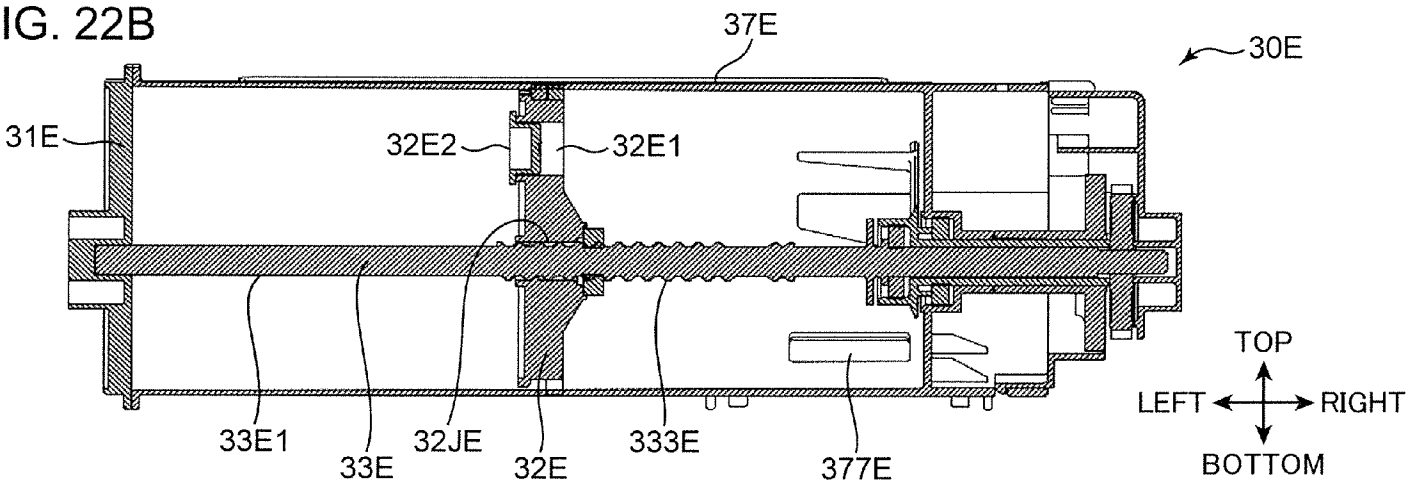

In the toner container 30D shown in FIGS. 21A, 21B, and 22A, a filling port 32D1 for supplying toner is formed in a movable wall 32D. In this configuration, toner is supplied before a lid 31D is welded to a container body 37D. Then, a filling port cap 32D2 is mounted.

The movable wall 32D includes a bearing 32JD that receives a shaft 33D therein. As described above, in the configuration where the movable wall 32D further has a filling port 32D1, the rigidity of the movable wall 32D readily decreases. In the configuration where the movable wall 32D has low rigidity, the movable wall 32D easily tilts with respect to the shaft 33D when the movable wall 32D moves toward a toner discharge port 377D along the shaft 33D. On the other hand, as in the configuration of the present embodiment where the filling port 37G is formed in the right wall 375 (FIGS. 18A and 18B), the movable wall 32 only needs to have the bearing 32J, and thus, the rigidity of the movable wall 32 is maintained at a high level.

In addition, a certain type of printer 100 has a plurality of set amounts for toner to be contained in a toner container 30. As one example, in the case where a plurality of sets of printable sheet number are provided for each toner container 30, the amount of toner to be contained in a toner container 30 beforehand is selected depending on the number of printable sheets. In the case where the toner container 30D is filled with a large amount of toner, toner is supplied in a state that the movable wall 32D is positioned at the left end as shown in FIG. 21A. On the other hand, in the case where the toner container 30D is filled with a small amount of toner, the supplied toner lies on the bottom of the toner container 30D as shown in FIG. 21B. In the case where the toner container 30D containing such small amount of toner is mounted on the printer 100, the movable wall 32D needs to be moved to the position shown in FIG. 22A before the printer 100 is started. As described above, the toner container 30D requires the time for initially moving the movable wall 32D in the production process of the printer 100 or at the place where the user uses the printer 100. This involves an increased number of operation steps for producing the printer 100 or an increased time for preparation at the used place.

With reference to FIG. 22B, a container body 37E of the toner container 30E has a toner discharge port 377E. In the toner container 30E, a male helical portion 333E is partially disposed in a central part of a shaft 33E in a first direction. A region 33E1 where no male helical portion 333E is formed and have only outer circumferential surface is defined on a left end of the shaft 33E. In this configuration, a movable wall 32E can be disposed at the position shown in FIG. 22B beforehand by permitting a bearing 32JE of the movable wall 32E to slide over the region 33E1. In this case, however, since toner is supplied through a filling port 32E1 in the state shown in FIG. 22B, it is necessary to insert a filler (nozzle) into the inside of the toner container 30E, which thus makes the shape of the filler complicated. In particular, in the case of using a slender filling nozzle reaching the filling port 32E1, the nozzle will be likely to be clogged with toner. In addition, since the movable wall 32E readily moves during filling, the filling efficiency decreases. Furthermore, since the position of the movable wall 32E is unstable, it is difficult to weld a filling port cap 32E2 to the filling port 32E1. On the other hand, in the configuration where the filling port 37G is formed in the right wall 375 as in the configuration of the present embodiment, toner can be supplied from the right wall 375 whose position is always fixed, irrespective of the amount of toner supply. In addition, in an assembly process of the toner container 30, the shaft 33 can be mounted into the container body 37 with the movable wall 32 being disposed at a predetermined position in the first direction on the shaft 33 beforehand. Thus, after the initial size of the storage space 37S is determined beforehand, the toner is supplied through the filling port 37G. As described above, in the present embodiment, even in the case where a plurality of amount sets for toner to be supplied to the storage space 37S are provided, and a plurality of initial positions for the movable wall 32 are provided in accordance with an amount of toner, a common filler can be used, and a toner supply process can be performed stably.

<Movement of Movable Wall>

While the first guide portion 312 of the lid 31 and the second guide portion 391 of the cover 39 are being guided by the pair of guide grooves 109A of the developing device 20, the toner container 30 is mounted into the container housing space 109 by a user (FIGS. 6 and 7). When the toner container 30 is mounted into the container housing space 109, the shutter 30S is moved so that the toner discharge port 377 is opened. Consequently, the toner discharge port 377 faces upward above the toner supply port 25 (FIGS. 4 and 5).

Figure 19A:
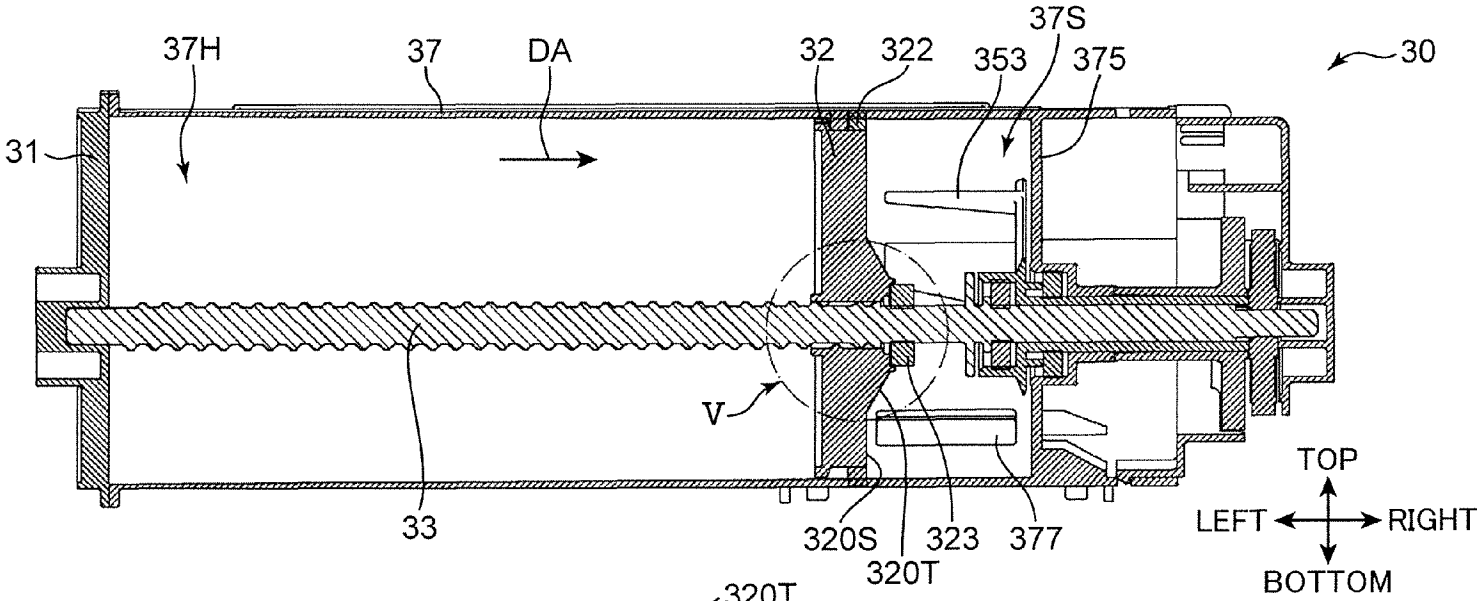
FIG. 19A is a sectional view of the developer container according to the embodiment of the present disclosure.
Figure 19B:
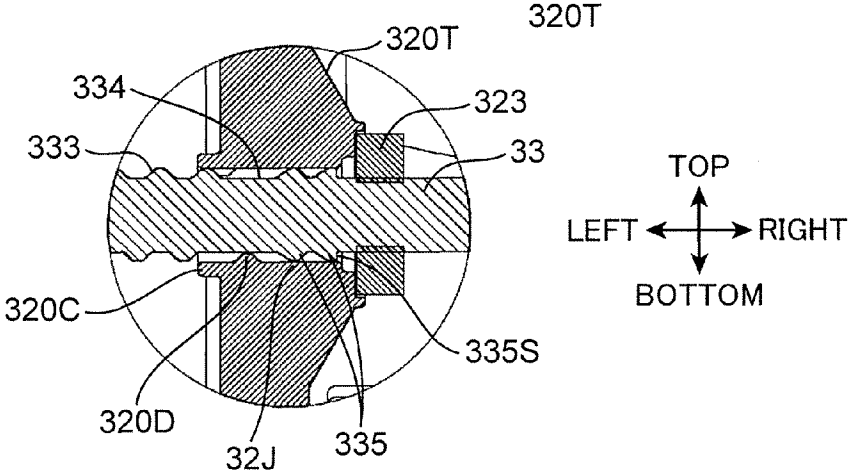
FIG. 19B is an enlarged sectional view of a part of the developer container shown in FIG. 19A.

FIG. 19A is a sectional view in which the movable wall 32 is disposed at the terminal position in the toner container 30, and FIG. 19B is an enlarged sectional view of a region V in FIG. 19A. FIG. 10 described above is a sectional view in which the movable wall 32 moves halfway from the initial position in the first direction. The initial position of the movable wall 32 is disposed along the lid 31, that is, at the left of the position of the movable wall 32 shown in FIG. 10.

When a new toner container 30 is mounted on the printer 100, the controller 50 (FIG. 7) puts into work the first motor M1 to rotationally drive the shaft 33 through the second gear 382 engaged with the third transmission gear 213. Consequently, the engagement of the male helical portion 333 of the shaft 33 and the female helical portion 320D of the movable wall 32 causes the movable wall 32 to move toward the toner discharge port 377 in the first direction (in the arrow DA direction in FIG. 10). Thereafter, when the movable wall 32 moves from the initial position rightward to a predetermined distance, the storage space 37S is filled with toner, and the toner sensor TS outputs a HIGH signal in accordance with the state of filling. In response to the HIGH signal from the toner sensor TS, the controller 50 stops the movable wall 32.

In the present embodiment, in a sectional view intersecting the first direction, each of the inner circumferential surfaces 37K of the container body 37 and the outer circumferential portion 32K of the movable wall 32 is not in the shape of a perfect circle. In particular, as shown in FIG. 17A, the inner circumferential portion 37K of the container body 37 is constituted by the bottom portion 371, the top portion 372, the front wall 373, and the rear wall 374 of the container body 37. In addition, a tilt portion 37TP is formed in an upper end portion of the rear wall 374 to be recessed toward the inside of the container body 37. As a result, the container body 37 is laterally asymmetric with respect to a vertical plane passing through the shaft 33. Since the grip 37L is disposed on the upper end of the tilt portion 37TP, the user can hold the toner container 30 by gripping the grip 37L and the front wall 373.

On the other hand, the outer circumferential portion 32K of the movable wall 32 that is in close contact with the inner circumferential portion 37K of the container body 37 also has a shape similar to that of the inner circumferential portion 37K. Thus, even under application of a rotary force around the shaft 33 to the movable wall 32, the engagement of the male helical portion 333 and the female helical portion 370D prevents the movable wall 32 from rotating (drag turning) around the shaft 33. Consequently, the movable wall 32 can be moved stably in the first direction with the torque of the first motor M1. In addition, the engagement of the male helical portion 333 and the female helical portion 370D makes it possible to move the movable wall 32 stably in the first direction with the outer circumferential portion 32K of the movable wall 32 being in close contact with the inner circumferential portion 37K of the container body 37 as described above.

In this manner, in the case where the engagement of the male helical portions 333 and the female helical portion 370D causes the movable wall 32 to move in the first direction (in the arrow DA direction in FIG. 10), a counterforce (thrust force) is applied to the shaft 33 in the direction of an arrow DJ in FIG. 10. Accordingly, during the movement of the movable wall 32, the end surface of the second shaft end 332 of the shaft 33 is in contact with the contact portion 311 of the lid 31. Consequently, the contact portion 311 functions to control the position of the shaft 33 in the first direction. Even in the case where the lid 31 is strongly pushed to the left by the shaft 33, the lid 31 is ultrasonic welded to the body flange 37F (FIG. 9) of the container body 37 in the present embodiment. Thus, it is possible to prevent the lid 31 from being peeled off from the container body 37. In addition, in the present embodiment, the contact portion 311 for controlling the position of the shaft 33 is disposed upstream of the movable wall 32 in the first direction. Thus, it is possible to prevent toner from being interposed in the contact portion between the shaft 33 and the contact portion 311. Accordingly, a failure in rotation of the shaft 33 due to adhesion of toner to the contact portion 311 is avoided.

As described above, the present embodiment employs the toner supply method of a volume replenishment type as shown in FIG. 5. Thus, in the case where the accumulation portion 29 (FIG. 5) in the developing device 20 seals the toner supply port 25 from below, replenishment toner does not fall off from the toner container 30. On the other hand, when the toner is supplied from the developing roller 21 of the developing device 20 to the photoconductive drum 121 so that the amount of toner in the accumulation portion 29 decreases, toner flows into the developing device 20 from the toner discharge port 377 through the toner supply port 25. Consequently, toner around the toner sensor TS disappears in the storage space 37S of the toner container 30, and accordingly, the toner sensor TS outputs a LOW signal. In response to the signal, the controller 50 drives the first motor M1 and further moves the movable wall 32 toward the toner discharge port 377 until the toner sensor TS outputs a HIGH signal.

The controller 50 puts into work the second motor M2 to rotationally drive the developing roller 21, for example, in accordance with developing operation of the developing device 20. In cooperation with this rotational movement, the stirring member 35 is rotated through the first gear 381 engaged with the second transmission gear 212. Consequently, the stirring member 35 disposed at the right end of the storage space 37S rotates around the shaft 33, and thus, toner above the toner discharge port 377 is stably stirred. Accordingly, the flowability of toner increases, and toner stably falls off from the toner discharge port 377. In particular, in the present embodiment, the stirring blades 353 project from the stirring supporting portions 352 of the stirring member 35. Thus, the revolution of the stirring blades 353 actively stirs toner around the toner discharge port 377.

When toner in the storage space 37S of the toner container 30 is continuously used, the movable wall 32 finally reaches the terminal position shown in FIG. 19A. In this manner, the movable wall 32 gradually moves in the first direction so that toner in the storage space 37S is conveyed to the toner discharge port 377 while being pressed by the movable wall 32. At this time, the storage space 37S is gradually downsized while the movable wall 32 moves to the terminal position. Thus, in the toner container 30, the space where toner remains itself gradually disappears. Consequently, as compared to a conventional toner container in which the volume of a storage space does not change, the amount of toner remaining in the storage space 37S of the container body 37 decreases after the use.

In the present embodiment, as shown in FIG. 19A, the movable wall 32 at the terminal position stops at a position slightly upstream of the toner discharge port 377 in the first direction. Specifically, with reference to FIG. 19B, when the bearing 32J of the movable wall 32 reaches the movable wall stopper portion 334 with the movement of the movable wall 32, the engagement of the male helical portion 333 and the female helical portion 320D is canceled. Consequently, locomotion is not transferred from the shaft 33 to the movable wall 32 anymore, and the movable wall 32 stops at the terminal position. At this time, since a space still remains above the toner discharge port 377, a small amount of toner remains in this space. In the present embodiment, however, toner can be completely discharged from the toner discharge port 377 with stability by rotatably driving the stirring member 35. The toner discharge port 377 is formed slightly above the lower end of the container body 37. Even in such a case, toner remaining in the lowest end of the container body 37 is scooped up by the stirring blades 353 (FIGS. 17B and 18B), and then is discharged from the toner discharge port 377 with stability.

Figure 23:
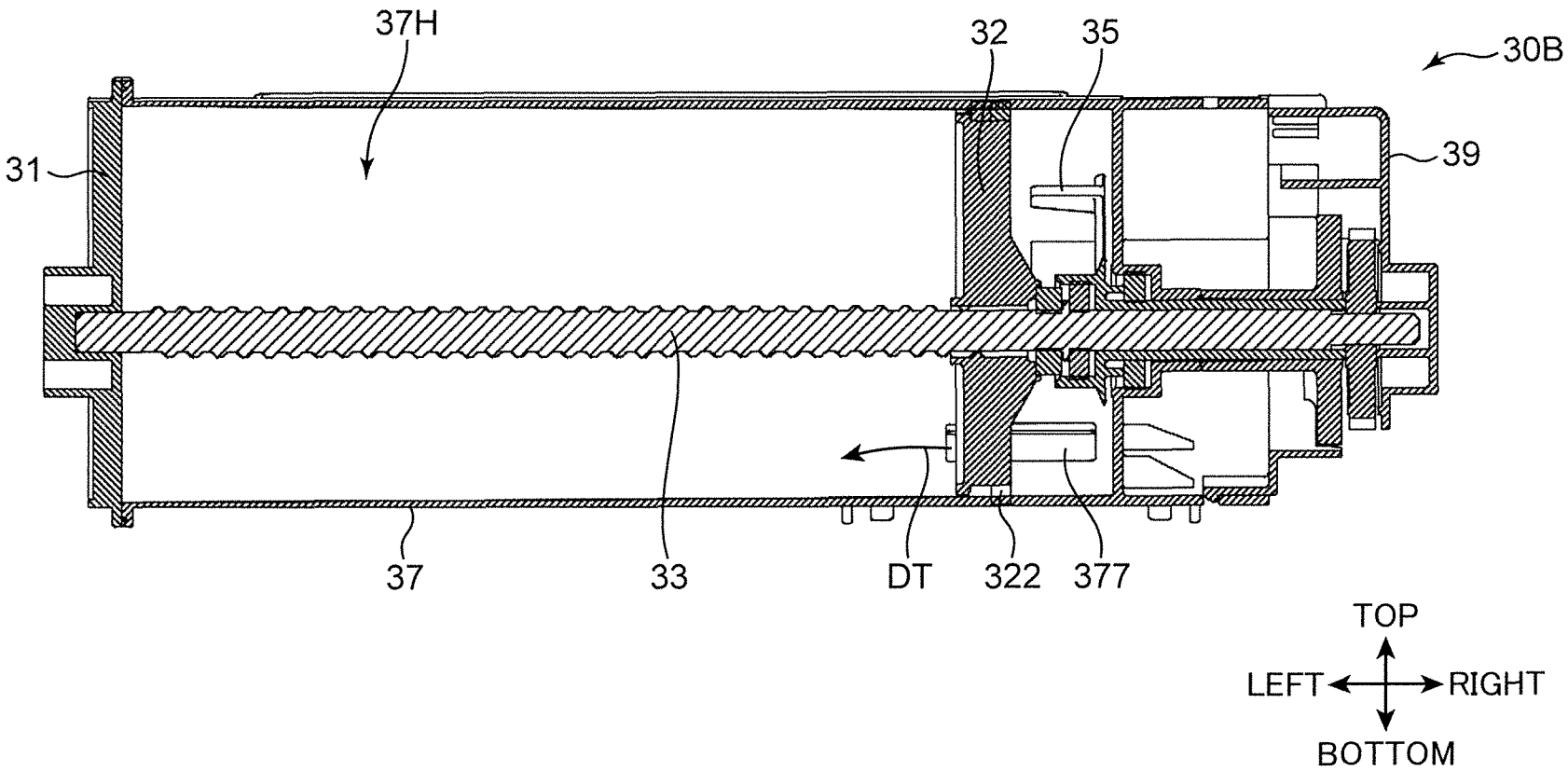
FIG. 23 is a sectional view of another developer container for comparison with the developer container according to the embodiment of the present disclosure.

At the terminal position of the movable wall 32, an upstream end of the outer circumferential portion 32K (FIG. 10) of the movable wall 32 in the first direction is disposed upstream of the upstream end of the toner discharge port 377 in the first direction. In particular, in the present embodiment, the upstream end of the inner wall seal 322 in the first direction is disposed upstream of the upstream end of the toner discharge port 377 in the first direction. FIG. 23 is a sectional view in which the movable wall 32 is disposed at the terminal position in a toner container 30B for comparison with the toner container 30 according to the present embodiment. In the toner container 30B, at the terminal position of the movable wall 32, the upstream end of the inner wall seal 322 of the movable wall 32 in the first direction is disposed downstream of the upstream end of the toner discharge port 377 in the first direction. Thus, as indicated by the arrow DT in FIG. 23, toner temporarily discharged from the toner discharge port 377 can erroneously flows into the internal space 37H disposed upstream of the movable wall 32 in some cases. In the present embodiment, the positional relationship between the movable wall 32 at the terminal position and the toner discharge port 377 is determined as described above so that such a flow of toner can be stably prevented. As described in the present embodiment, in the case of employing a toner supply method of a volume replenishment type, when the toner container 30 becomes empty of toner, a pressing force of replenishment toner that presses the accumulation portion 29 toward the developing device 20 from the toner container 30 is lost. In this case, toner in the developing device 20 can flow backward from the toner supply port 25 toward the toner discharge port 377 in some conditions in the developing device 20. In this manner, even in the case where toner more easily flows backward, the terminal position of the movable wall 32 is disposed so as to prevent an erroneous flow of toner into the internal space 37H upstream of the movable wall 32.

In addition, with reference to FIG. 19A, at the terminal position of the movable wall 32, the conveying surface 320S of the movable wall 32 is disposed upstream of, and spaced apart from, the stirring blades 353 of the stirring member 35 in the first direction. Thus, it is possible to prevent the conveying surface 320S of the movable wall 32 at the terminal position and the stirring member 35 from interfering with each other. Accordingly, even in the case where the stirring member 35 continues to rotate in order to discharge toner remaining in the container body 37, aggregation of toner is prevented without frictional sliding of the stirring member 35 with the movable wall 32. Even in the case where the developing device 20 continues to be used in a predetermined period with the toner container 30 being empty and the stirring member 35 continues to be used in synchronization with the developing roller 21, it is also possible to prevent the movable wall 32 and the stirring member 35 from interfering with each other. As described above, the movable wall stopper portion 334 of the shaft 33 ensures that movement of the movable wall 32 stops at the terminal position. Thus, it is further ensured to prevent the movable wall 32 and the stirring member 35 from interfering with each other. Further, when the movable wall 32 is at the terminal position shown in FIG. 19A, the inner wall seal 322 of the movable wall 32 resiliently biases the inner circumferential portion 37K of the toner container 30 radially from the inside. Therefore, the movable wall 32 is stably locked at the terminal position so that movement of the movable wall 32 toward the stirring member 35 is prevented.

In the present embodiment, as shown in FIG. 19A, the upstream end of the stirring blades 353 of the stirring member 35 in the first direction is disposed slightly downstream of the upstream end of the toner discharge port 377 in the first direction. In other embodiment, the upstream end of the stirring blades 353 of the stirring member 35 in the first direction may be disposed at the same position as the upstream end of the toner discharge port 377 in the first direction. This positioning of the stirring blades 353 and the toner discharge port 377 can achieve stable stirring and discharge of toner around the toner discharge port 377. In addition, since the stirring blades 353 does not project to the upstream side from the toner discharge port 377 in the first direction, the terminal position of the movable wall 32 can be placed as close to the toner discharge port 377 as possible.

Furthermore, in the present embodiment, the conveying surface 320S of the movable wall 32 includes the tapered surface 320T (FIG. 19A). The shaft seal 323 is disposed at the front end of the tapered surface 320T. When the movable wall 32 is at the terminal position, the downstream end of the shaft seal 323 in the first direction is disposed downstream of the upstream end of the toner discharge port 377 in the first direction. In this manner, the terminal position of the movable wall 32 is determined in such a manner that the tapered surface 320T and the shaft seal 323 enter the stirring blades 353 radially inward, whereby the terminal position of the movable wall 32 can be made much closer to the toner discharge port 377. The movable wall stopper portion 334 and the movable wall supporter portions 335 of the shaft 33 can be disposed in the first direction to face the bearing 32J of the movable wall 32 with sufficient margins. In other words, the presence of the tapered surface 320T increases the thickness of the movable wall 32 in the first direction, and thus, a region where the movable wall stopper portion 334 and the movable wall supporter portions 335 are disposed can be made large in the first direction. In addition, the presence of the tapered surface 320T enables the shaft seal 323 to be disposed downstream of, and spaced apart from, the female helical portion 320D in the first direction. Thus, it is possible to prevent toner from excessively entering the female helical portion 320D.

Figure 24B:
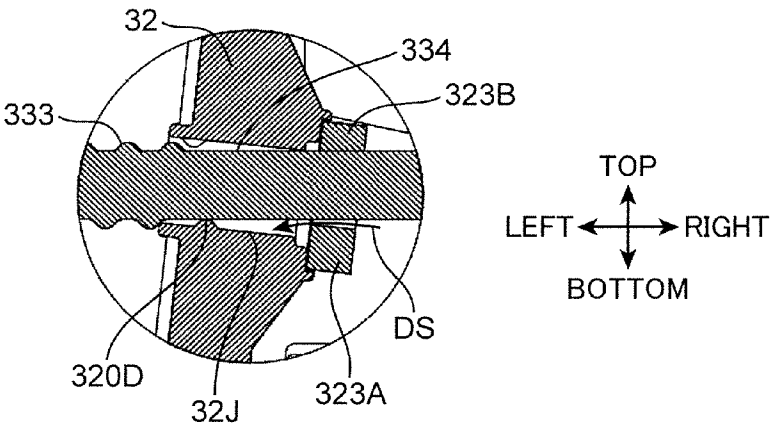

In the present embodiment, the bearing 32J is supported by the movable wall supporter portions 335 disposed downstream of the movable wall stopper portion 334 in the first direction in addition to the downstream end of the male helical portion 333 in the first direction. Thus, tilt of the movable wall 32 at the terminal position with respect to the shaft 33 is suppressed. In particular, tilt of the conveying surface 320S of the movable wall 32 with respect to the first direction is suppressed. FIG. 24A is a sectional view of a toner container 30C for comparison with the toner container 30 according to the present embodiment. FIG. 24B is an enlarged sectional view of a region VI in FIG. 24A. The toner container 30C is different from the toner container 30 in that the toner container 30C does not include the movable wall supporter portions 335 of the present embodiment. As shown in FIG. 24B, when the movable wall 32 of the toner container 30C reaches the terminal position, the female helical portion 320D is detached from the male helical portion 333. At this time, since the gap between the inner circumferential surface of the bearing 32J and the outer circumferential surface of the movable wall stopper portion 334 is large, the movable wall 32 tilts as shown in FIG. 24B. Accordingly, a lower part 323A of the shaft seal 323 at the front end of the bearing 32J comes to be separated from the movable wall stopper portion 334. Accordingly, as indicated by the arrow DS, after having entered the bearing 32J, toner easily flows out to the upstream side of the movable wall 32 in the first direction. Similarly, an upper part 323B of the shaft seal 323 is excessively pressed against the movable wall stopper portion 334, and thus, the shaft seal 323 is greatly deformed. Consequently, toner also easily enters the bearing 32J. In addition, when the movable wall 32 tilts with respect to the shaft 33, the amount of compression of the inner wall seal 322 at the outer circumferential portion 32K of the movable wall 32 changes. Consequently, toner easily flows to the upstream side in the first direction through the gap between the container body 37 and the movable wall 32.

On the other hand, in the present embodiment, the shaft 33 includes the movable wall supporter portions 335. Thus, tilt of the movable wall 32 is reduced, and local deformation of the inner wall seal 322 and the shaft seal 323 is prevented. Consequently, it is possible to prevent toner from flowing out to the side upstream of the movable wall 32 through the gap between the movable wall 32 and the inner circumferential portion 37K of the container body 37 and through the main body bearing 37J. In addition, tilt of the movable wall 32 is suppressed, thereby making it possible to prevent the conveying surface 320S of the movable wall 32 at the terminal position from interfering with the stirring member 35.

The height of the movable wall supporter portions 335 projecting from the shaft 33 is preferably equal to the height of the projection of the male helical portion 333 or slightly larger than the height of the projection of the male helical portion 333. This ensures that the movable wall supporter portions 335 supports the bearing 32J. In addition, since the movable wall supporter portions 335 is in the shape of a ring disposed in the circumferential direction on the circumferential surface of the shaft 33, the bearing 32J is stably supported by the movable wall supporter portions 335 over the entire circumference of the shaft 33.

Furthermore, as shown in FIGS. 13B and 19B, since the multiple movable wall supporter portions 335 are arranged in the first direction, the bearing 32J is stably supported in a predetermined range in the first direction. The second supporter 335B of the movable wall supporter portions 335 includes the side end surface 335C (FIG. 19B) perpendicular to the first direction. Thus, the movable wall supporter portions 335 can support the bearing 32J as close to the downstream end as possible in the first direction. Consequently, the terminal position of the movable wall 32 can be disposed closer to the toner discharge port 377.

The toner container 30 and the printer 100 including the toner container 30 according to the present disclosure have been described above. However, the present disclosure is not limited to the above-described embodiments and, for example, the following modified embodiments may be adopted.

(1) The above-described embodiment has been described with reference to a monochrome printer as a printer 100. However, the present disclosure is not limited to such printer. In particular, in the case of a tandem color printer as a printer 100, after an opening/closing cover 100C (FIG. 2) of the printer 100 is opened, toner containers 30 respectively corresponding to a plurality of colors may be mounted into a housing 101 from above so as to be adjacent to one another.

(2) The above-described embodiment employs the volume replenishment type toner supply method. However, the present disclosure is not limited to this method. The developing device 20 may further include an unillustrated toner sensor. When the toner sensor detects a decrease of toner in the developing device 20, the controller 50 causes the first motor M1 to run to move the movable wall 32 in the first direction. Consequently, toner is caused to fall through the toner discharge port 377 to flow into the developing device 20.

(3) In the above-described embodiment, the bearing 32J is disposed substantially in the central part of the movable wall 32. However, the present disclosure is not limited to this configuration. The bearing 32J may be disposed in another part of the movable wall 32. It may be appreciated to dispose a bearing 32J in an upper end of a movable wall 32, and dispose a corresponding shaft 33 extending in an upper part of a container body 37 in the first direction. In this case, the pressure of toner onto a shaft seal 323 (FIGS. 19A and 19B) lowers, consequently keeping the sealing ability of the shaft seal 323 at a higher level.

(4) The above-described embodiment has been described with reference to the configuration that the movable wall 32 moves from the position closer to the lid 31 to the position closer to the right wall 375. However, the present disclosure is not limited to this configuration. Another configuration may be appreciated that has a toner discharge port 377 formed in a portion closer to the lid 31, and a movable wall 32 movable from a position closer to a right wall 375 toward a lid 31. Also, the stirring member 35 that moves above the toner discharge port 377 is not limited to the shape described in the above-described embodiment. Another stirring member 35 may be appreciated that has other shape operable to stir toner around the toner discharge port 377.

Figure 20:
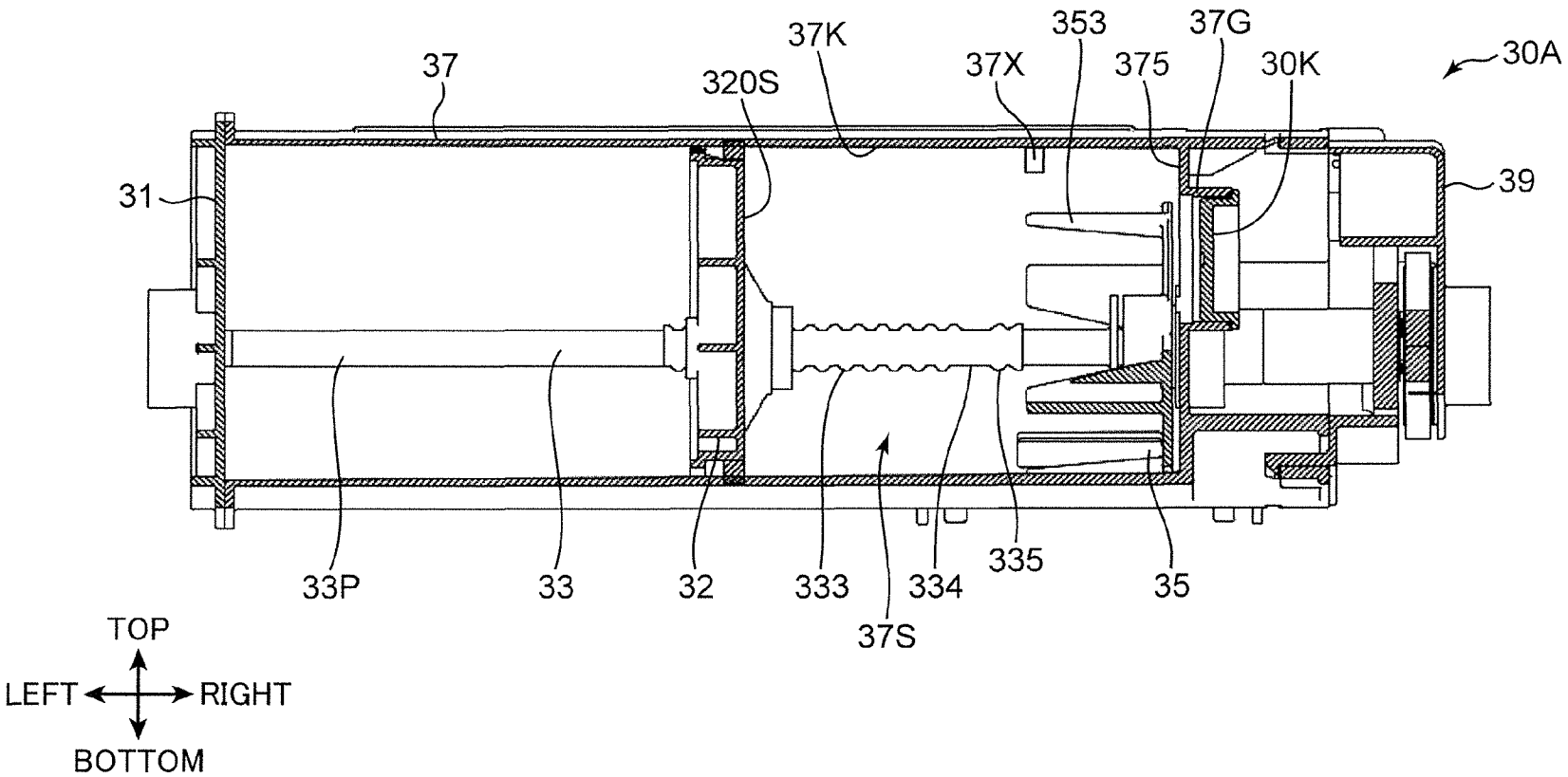
FIG. 20 is a sectional view of a developer container according to a modified embodiment of the present disclosure.

(5) In the above-described embodiment, the movable wall supporter portion 335 is provided on the shaft 33 to maintain the posture of the movable wall 32 and function as a tilt suppressing mechanism operable to suppress tilt. However, the present disclosure is not limited to this configuration. FIG. 20 is a sectional view of a toner container 30A according to a modified embodiment according to the present disclosure. The present modified embodiment is different from the above-described embodiment in that the toner container 30A includes a projection member 37X, instead of the movable wall supporter portion 335. The projection member 37X projects from an inner circumferential portion 37K of a container body 37 radially inward. In the present modified embodiment, when the movable wall 32 reaches the terminal position corresponding to the movable wall stopper portion 334, a conveying surface 320S comes in contact with the projection member 37X to thereby suppress tilt of the movable wall 32 with respect to the first direction.

In addition, as shown in FIG. 20, the projection member 37X is disposed above the shaft 33 and projects downward from the inner circumferential portion 37K of the container body 37. Thus, as compared to a configuration where a projection member is disposed on a bottom portion of the container body 37, the projection member 37X has less likelihood of interrupting flow of toner toward a toner discharge port 377.

In a case where the projection member 37X is molded integrally with the container body 37, the projection member 37X shown in FIG. 20 may be in the form of a rib extending to the right wall 375 in the first direction. In this case, when the container body 37 is pulled out from a mold, the rib-shaped projection extending in the first direction is formed.

In addition, in the present modified embodiment, the shaft 33 includes a shaft guide portion 33P (FIG. 20). The shaft guide portion 33P is a region where no male helical portion 333 is formed to a predetermined extent closer to the left end of the shaft 33. In the toner container 30A, the initial position of the movable wall 32 is set at the position of the movable wall 32 shown in FIG. 20. The toner containing capacity of the toner container 30A is approximately a half of the toner containing capacity of the toner container 30 according to the above-described embodiment. In assembling process of the toner container 30A, the movable wall 32 is slid along the shaft guide portion 33P of the shaft 33, whereby the movable wall 32 can be promptly disposed at the initial position without rotation of the shaft 33. In this manner, the position of the upstream end of the male helical portion 333 formed on the shaft 33 in the first direction and the initial position of the movable wall 32 are set in accordance with the amount of toner to be contained in the storage space 37S. The upstream end of the male helical portion 333 is positioned further upstream in the first direction in the case where the storage space 37S is filled with toner at a first amount as the toner container 30 than in the case where the storage space 37S is filled with toner at a second amount smaller than the first amount as the toner container 30A. In other words, the upstream end of the male helical portion 333 is set further downstream in the first direction in a case where an amount of the developer filled with the storage space 37S is smaller. Consequently, the volume of the storage space 37S can be set in accordance with a predetermined amount of toner to be contained in the storage space 37S.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A developer container comprising:

a container body including an inner circumferential surface defining a cylindrical internal space extending in a first direction, and having opposite first and second longitudinal ends, a wall part at the first end of the cylindrical inner space and defining a first end surface of the internal space, an opening at the second end of the internal space opposite to the wall part, and the container body being formed with a developer discharge port to communicate with the internal space and to discharge developer therethrough, the developer discharge port being closer to the wall part at the first end of the internal space than to the opening at the second end thereof;

a lid mounted on the container body in the first direction to cover the opening at the second end of the internal space;

a movable wall including an outer circumferential surface slidable over and in close contact with the inner circumferential surface of the container body, and a conveying surface defining a storage space for the developer in cooperation with the inner circumferential surface and the wall part of the container body, the movable wall being movable in the internal space in the first direction from an initial position closer to the lid of the container body to a terminal position closer to the wall part while conveying the developer in the storage space to the developer discharge port; and a sealing member;

a shaft including a first engaging portion in the form of a helical ridge in an outer circumferential surface thereof, extending in the first direction in the internal space, and one end and the other end of the shaft being supported on the wall part and the lid rotatably;

a bearing portion disposed on the movable wall for allowing the shaft to be inserted, and including a second engaging portion on an inner circumferential surface thereof and engaging with the first engaging portion;

a torque transfer section for transferring a torque to the shaft;

a projecting wall projecting from the wall part at a side opposite to the lid and having a cylindrical shape, and a cover mounted to an end of the projecting wall, wherein the wall part has a developer filling port penetrating the wall part in a mounting direction in which the lid is mounted on the container body and communicating with the storage space, the sealing member seals the developer filling port, when the shaft is rotated, owing to the engagement of the first engaging portion and the second engaging portion, the movable wall moves along the shaft in the first direction, and the cover covers the developer filling port sealed by the sealing member.

2. A developer container according to claim 1, further comprising:

a stirring member disposed in the storage space facing the wall part, and rotatably around the shaft to stir the developer in the storage space; wherein the stirring member exposes the developer filling port when the stirring member is at a predetermined rotational position around the shaft in view of the wall part from upstream in the first direction in the internal space.

3. A developer container according to claim 2, wherein the stirring member includes a plurality of base blades extending radially outward from the shaft along the wall part and disposed at a distance in a circumferential direction of the shaft, and the developer filling port is exposed between the base blades when the stirring member is at the predetermined rotational position around the shaft.

4. A developer container according to claim 3, further comprising:

a blade part projecting from each of the base blades to the upstream in the first direction and operable to move above the developer discharge port.

5. A developer container according to claim 1, wherein the initial position of the movable wall is set in accordance with an amount of developer to be contained in the storage space.

6. An image forming apparatus, comprising:

a developer container according to claim 1;

an image carrier configured to allow an electrostatic latent image to be formed on a surface thereof, and to carry a developed image;

a developing device configured to receive developer supplied from the developer container and supply the developer to the image carrier; and a transfer section configured to transfer the developed image from the image carrier onto a sheet.

7. An image forming apparatus according to claim 6, wherein the developer container is mounted on a predetermined main body in a direction intersecting the first direction, the cover includes:

a sidewall disposed to face the developer filling port; and a guide portion projecting from an outside surface opposite to an inside surface basing the developer filling portion of the side wall of the cover and configured to guide the mounting of the developer container on the main body.

8. A developer container according to claim 1, wherein:

the torque transfer section includes a gear fixed on the shaft in the cylinder of the projecting wall, the cover has a semi-arc shaped opening opened in a lower portion of the cover, and a part of the gear is exposed to the outside of the developer container through the opening and the cover covers the gear.

9. A developer container according to claim 8, wherein:

an end of the shaft penetrating the torque transfer section is housed in the cover.

10. A developer container according to claim 1, wherein the developer container is mounted on a predetermined main body in a direction intersecting the first direction, the cover includes:

a sidewall disposed to face the developer filling port; and a guide portion projecting from an outside surface opposite to an inside surface basing the developer filling portion of the side wall of the cover and configured to guide the mounting of the developer container on the main body.

* * * * *